US007854620B2

(12) United States Patent
Hughes et al.

(10) Patent No.: US 7,854,620 B2
(45) Date of Patent: Dec. 21, 2010

(54) SHIELD HOUSING FOR A SEPARABLE CONNECTOR

(75) Inventors: David Charles Hughes, Rubicon, WI (US); Paul Michael Roscizewski, Eagle, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 12/341,161

(22) Filed: Dec. 22, 2008

(65) Prior Publication Data

US 2009/0111324 A1 Apr. 30, 2009

Related U.S. Application Data

(63) Continuation-in-part of application No. 11/676,861, filed on Feb. 20, 2007, now Pat. No. 7,494,355.

(51) Int. Cl.
*H01R 13/53* (2006.01)

(52) U.S. Cl. ..... 439/181; 439/921

(58) Field of Classification Search ..... 439/181, 439/184, 183, 185, 921, 205
See application file for complete search history.

(56) References Cited

U.S. PATENT DOCUMENTS

| | | | |
|---|---|---|---|
| 1,903,956 | A | 4/1933 | Christie et al. |
| 2,953,724 | A | 9/1960 | Hilfiker et al. |
| 3,115,329 | A | 12/1963 | Wing et al. |
| 3,315,132 | A | 4/1967 | Lucas |
| 3,392,363 | A | 7/1968 | Geis, Jr. et al. |
| 3,471,669 | A | 10/1969 | Curtis |
| 3,474,386 | A | 10/1969 | Link |
| 3,509,516 | A | 4/1970 | Phillips |

(Continued)

FOREIGN PATENT DOCUMENTS

| | | | |
|---|---|---|---|
| DE | 3110609 | A1 | 7/1982 |

(Continued)

OTHER PUBLICATIONS

A-NPL: Cooper Power Systems; Loadbreak Apparatus Connectors, 200 A 25 kV Class Loadbreak Bushing Insert, Service Information 500-26; May 2003; 2 pages.

(Continued)

*Primary Examiner*—Neil Abrams
*Assistant Examiner*—Phuong Nguyen
(74) *Attorney, Agent, or Firm*—King & Spalding LLP

(57) ABSTRACT

A separable connector shield housing includes a layer of conductive material disposed at least partially around a layer of non-conductive material. The layers are molded together. For example, the conductive material can be overmolded around the non-conductive material, or the non-conductive material can be insert molded within the conductive material. The molding results in an easy to manufacture, single-component shield housing with reduced potential for air gaps and electrical discharge. The shield housing defines a channel within which at least a portion of a contact tube may be received. A contact element is disposed within the contact tube. The conductive material substantially surrounds the contact element. The non-conductive material can extend along an entire length of the contact tube and other components, or it may only extend partially along the contact tube. The non-conductive material can include an integral nose piece disposed along a nose end of the contact tube.

20 Claims, 11 Drawing Sheets

U.S. PATENT DOCUMENTS

| | | | | |
|---|---|---|---|---|
| 3,509,518 | A | | 4/1970 | Phillips |
| 3,513,425 | A | | 5/1970 | Arndt |
| 3,539,972 | A | | 11/1970 | Ruete et al. |
| 3,542,986 | A | | 11/1970 | Kotski |
| 3,546,535 | A | | 12/1970 | Van Riemsdijk |
| 3,576,493 | A | | 4/1971 | Tachick et al. |
| 3,594,685 | A | | 7/1971 | Cunningham |
| 3,652,975 | A | | 3/1972 | Keto |
| 3,654,590 | A | | 4/1972 | Brown |
| 3,663,928 | A | | 5/1972 | Keto et al. |
| 3,670,287 | A | | 6/1972 | Keto |
| 3,678,432 | A | | 7/1972 | Boliver |
| 3,720,904 | A | | 3/1973 | De Sio |
| 3,725,846 | A | | 4/1973 | Strain |
| 3,740,503 | A | | 6/1973 | Tomohiro et al. |
| 3,740,511 | A | | 6/1973 | Westmoreland |
| 3,798,586 | A | | 3/1974 | Huska |
| 3,826,860 | A | | 7/1974 | De Sio et al. |
| 3,845,233 | A | | 10/1974 | Burton |
| 3,860,322 | A | | 1/1975 | Sankey et al. |
| 3,915,534 | A | | 10/1975 | Yonkers |
| 3,924,914 | A | | 12/1975 | Banner |
| 3,945,699 | A | | 3/1976 | Westrom |
| 3,949,343 | A | | 4/1976 | Yonkers |
| 3,953,099 | A | | 4/1976 | Wilson |
| 3,955,874 | A | | 5/1976 | Boliver |
| 3,957,332 | A | | 5/1976 | Lambert, III |
| 3,960,433 | A | | 6/1976 | Boliver |
| 4,029,380 | A | | 6/1977 | Yonkers |
| 4,040,696 | A | | 8/1977 | Wada et al. |
| 4,067,636 | A | | 1/1978 | Boliver et al. |
| 4,088,383 | A | | 5/1978 | Fischer et al. |
| 4,102,608 | A | | 7/1978 | Balkau et al. |
| 4,103,123 | A | | 7/1978 | Marquardt, Jr. |
| 4,107,486 | A | | 8/1978 | Evans |
| 4,113,339 | A | | 9/1978 | Eley |
| 4,123,131 | A | | 10/1978 | Pearce, Jr. et al. |
| 4,152,643 | A | | 5/1979 | Schweitzer, Jr. |
| 4,154,993 | A | | 5/1979 | Kumbera et al. |
| 4,161,012 | A | | 7/1979 | Cunningham |
| 4,163,118 | A | | 7/1979 | Marien et al. |
| 4,186,985 | A | * | 2/1980 | Stepniak et al. ..... 439/185 |
| 4,203,017 | A | | 5/1980 | Lee |
| 4,210,381 | A | * | 7/1980 | Borgstrom ..... 439/161 |
| 4,223,179 | A | | 9/1980 | Lusk et al. |
| 4,260,214 | A | | 4/1981 | Dorn |
| 4,343,356 | A | | 8/1982 | Riggs et al. |
| 4,353,611 | A | | 10/1982 | Siebens et al. |
| 4,354,721 | A | | 10/1982 | Luzzi |
| 4,360,967 | A | | 11/1982 | Luzzi et al. |
| 4,443,054 | A | | 4/1984 | Ezawa et al. |
| 4,463,227 | A | | 7/1984 | Dizon et al. |
| 4,484,169 | A | | 11/1984 | Nishikawa |
| 4,500,935 | A | | 2/1985 | Tsuruta et al. |
| 4,508,413 | A | | 4/1985 | Bailey |
| 4,568,804 | A | | 2/1986 | Luehring |
| 4,600,260 | A | | 7/1986 | Stepniak et al. |
| 4,626,755 | A | | 12/1986 | Butcher et al. |
| 4,638,403 | A | | 1/1987 | Amano et al. |
| 4,678,253 | A | | 7/1987 | Hicks, Jr. et al. |
| 4,688,013 | A | | 8/1987 | Nishikawa |
| 4,700,258 | A | | 10/1987 | Farmer |
| 4,714,438 | A | | 12/1987 | Williams |
| 4,715,104 | A | | 12/1987 | Schoenwetter et al. |
| 4,722,694 | A | | 2/1988 | Makal et al. |
| 4,767,894 | A | | 8/1988 | Schombourg |
| 4,767,941 | A | | 8/1988 | Brand et al. |
| 4,779,341 | A | | 10/1988 | Roscizewski |
| 4,793,637 | A | | 12/1988 | Laipply et al. |
| 4,799,895 | A | | 1/1989 | Borgstrom |
| 4,820,183 | A | | 4/1989 | Knapp et al. |
| 4,822,291 | A | | 4/1989 | Cunningham |
| 4,822,951 | A | | 4/1989 | Wilson et al. |
| 4,834,677 | A | | 5/1989 | Archang |
| 4,857,021 | A | | 8/1989 | Boliver et al. |
| 4,863,392 | A | | 9/1989 | Borgstrom et al. |
| 4,867,687 | A | | 9/1989 | Williams et al. |
| 4,871,888 | A | | 10/1989 | Bestel |
| 4,875,581 | A | | 10/1989 | Ray et al. |
| 4,891,016 | A | | 1/1990 | Luzzi et al. |
| 4,911,655 | A | | 3/1990 | Pinyan et al. |
| 4,946,393 | A | | 8/1990 | Borgstrom et al. |
| 4,955,823 | A | | 9/1990 | Luzzi |
| 4,972,049 | A | | 11/1990 | Muench |
| 4,982,059 | A | | 1/1991 | Bestel |
| 5,025,121 | A | | 6/1991 | Allen et al. |
| 5,045,656 | A | | 9/1991 | Kojima |
| 5,045,968 | A | | 9/1991 | Suzuyama et al. |
| 5,053,584 | A | | 10/1991 | Chojnowski |
| 5,101,080 | A | | 3/1992 | Ferenc |
| 5,114,357 | A | | 5/1992 | Luzzi |
| 5,128,824 | A | | 7/1992 | Yaworski et al. |
| 5,130,495 | A | | 7/1992 | Thompson |
| 5,132,495 | A | | 7/1992 | Ewing et al. |
| 5,166,861 | A | | 11/1992 | Krom |
| 5,175,403 | A | | 12/1992 | Hamm et al. |
| 5,213,517 | A | | 5/1993 | Kerek et al. |
| 5,215,475 | A | | 6/1993 | Stevens |
| 5,221,220 | A | | 6/1993 | Roscizewski |
| 5,230,142 | A | | 7/1993 | Roscizewski |
| 5,230,640 | A | | 7/1993 | Tardif |
| 5,248,263 | A | | 9/1993 | Sakurai et al. |
| 5,266,041 | A | | 11/1993 | De Luca |
| 5,277,605 | A | | 1/1994 | Roscizewski et al. |
| 5,356,304 | A | | 10/1994 | Colleran |
| 5,358,420 | A | | 10/1994 | Cairns et al. |
| 5,359,163 | A | | 10/1994 | Woodard |
| 5,393,240 | A | | 2/1995 | Makal et al. |
| 5,422,440 | A | | 6/1995 | Palma |
| 5,427,538 | A | | 6/1995 | Knapp et al. |
| 5,429,519 | A | | 7/1995 | Murakami et al. |
| 5,433,622 | A | | 7/1995 | Galambos |
| 5,435,747 | A | | 7/1995 | Franckx et al. |
| 5,445,533 | A | | 8/1995 | Roscizewski et al. |
| 5,468,164 | A | | 11/1995 | Demissy |
| 5,492,487 | A | | 2/1996 | Cairns et al. |
| 5,525,069 | A | | 6/1996 | Roscizewski et al. |
| 5,589,671 | A | | 12/1996 | Hackbarth et al. |
| 5,619,021 | A | | 4/1997 | Yamamoto et al. |
| 5,641,310 | A | | 6/1997 | Tiberio, Jr. |
| 5,655,921 | A | | 8/1997 | Makal et al. |
| 5,661,280 | A | | 8/1997 | Kuss et al. |
| 5,667,060 | A | | 9/1997 | Luzzi |
| 5,717,185 | A | | 2/1998 | Smith |
| 5,736,705 | A | | 4/1998 | Bestel et al. |
| 5,737,874 | A | | 4/1998 | Sipos et al. |
| 5,747,765 | A | | 5/1998 | Bestel et al. |
| 5,747,766 | A | | 5/1998 | Waino et al. |
| 5,757,260 | A | | 5/1998 | Smith et al. |
| 5,766,030 | A | | 6/1998 | Suzuki |
| 5,766,517 | A | | 6/1998 | Goedde et al. |
| 5,795,180 | A | | 8/1998 | Siebens |
| 5,799,986 | A | | 9/1998 | Corbett et al. |
| 5,808,258 | A | | 9/1998 | Luzzi |
| 5,816,835 | A | | 10/1998 | Meszaros |
| 5,846,093 | A | | 12/1998 | Muench, Jr. et al. |
| 5,857,862 | A | | 1/1999 | Muench et al. |
| 5,864,942 | A | | 2/1999 | Luzzi |
| 5,886,294 | A | | 3/1999 | Scrimpshire et al. |
| 5,912,604 | A | | 6/1999 | Harvey et al. |
| 5,917,167 | A | | 6/1999 | Bestel |
| 5,936,825 | A | | 8/1999 | DuPont |
| 5,949,641 | A | | 9/1999 | Walker et al. |
| 5,953,193 | A | | 9/1999 | Ryan |

| | | | |
|---|---|---|---|
| 5,957,712 | A | 9/1999 | Stepniak |
| 6,022,247 | A | 2/2000 | Akiyama et al. |
| 6,040,538 | A | 3/2000 | French et al. |
| 6,042,407 | A | 3/2000 | Scull et al. |
| 6,069,321 | A | 5/2000 | Wagener et al. |
| 6,071,130 | A | 6/2000 | Johnson |
| 6,103,975 | A | 8/2000 | Krabs et al. |
| 6,116,963 | A | 9/2000 | Shutter |
| 6,130,394 | A | 10/2000 | Hogl |
| 6,168,447 | B1 | 1/2001 | Stepniak et al. |
| 6,179,639 | B1 | 1/2001 | Kuwahara et al. |
| 6,205,029 | B1 | 3/2001 | Byrne et al. |
| 6,213,799 | B1 | 4/2001 | Jazowski et al. |
| 6,220,888 | B1 | 4/2001 | Correa |
| 6,227,908 | B1 | 5/2001 | Aumeier et al. |
| 6,250,950 | B1 | 6/2001 | Pallai |
| 6,280,659 | B1 | 8/2001 | Sundin |
| 6,305,563 | B1 | 10/2001 | Elliott |
| 6,332,785 | B1 | 12/2001 | Muench, Jr. et al. |
| 6,338,637 | B1 | 1/2002 | Muench, Jr. et al. |
| 6,362,445 | B1 | 3/2002 | Marchand et al. |
| 6,364,216 | B1 | 4/2002 | Martin |
| 6,416,338 | B1 | 7/2002 | Berlovan |
| 6,429,373 | B1 | 8/2002 | Scrimpshire et al. |
| 6,453,776 | B1 | 9/2002 | Beattie et al. |
| 6,478,584 | B2 | 11/2002 | Vile et al. |
| 6,504,103 | B1 | 1/2003 | Meyer et al. |
| 6,517,366 | B2 | 2/2003 | Bertini et al. |
| 6,520,795 | B1 | 2/2003 | Jazowski |
| 6,538,312 | B1 | 3/2003 | Peterson et al. |
| 6,542,056 | B2 | 4/2003 | Nerstrom et al. |
| 6,566,996 | B1 | 5/2003 | Douglass et al. |
| 6,585,531 | B1 | 7/2003 | Stepniak et al. |
| 6,664,478 | B2 | 12/2003 | Mohan et al. |
| 6,674,159 | B1 | 1/2004 | Peterson et al. |
| 6,689,947 | B2 | 2/2004 | Ludwig |
| 6,705,898 | B2 | 3/2004 | Pechstein et al. |
| 6,709,294 | B1 | 3/2004 | Cohen et al. |
| 6,733,322 | B2 | 5/2004 | Boemmel et al. |
| 6,744,255 | B1 | 6/2004 | Steinbrecher et al. |
| 6,790,063 | B2 | 9/2004 | Jazowski et al. |
| 6,796,820 | B2 | 9/2004 | Jazowski et al. |
| 6,809,413 | B1 | 10/2004 | Peterson et al. |
| 6,811,418 | B2 | 11/2004 | Jazowski et al. |
| 6,830,475 | B2 | 12/2004 | Jazowski et al. |
| 6,843,685 | B1 | 1/2005 | Borgstrom et al. |
| 6,888,086 | B2 | 5/2005 | Daharsh et al. |
| 6,905,356 | B2 | 6/2005 | Jazowski et al. |
| 6,936,947 | B1 | 8/2005 | Leijon et al. |
| 6,939,151 | B2 | 9/2005 | Borgstrom et al. |
| 6,972,378 | B2 | 12/2005 | Schomer et al. |
| 6,984,791 | B1 | 1/2006 | Meyer et al. |
| 7,018,236 | B2 | 3/2006 | Nishio et al. |
| 7,019,606 | B2 | 3/2006 | Williams et al. |
| 7,044,760 | B2 | 5/2006 | Borgstrom et al. |
| 7,044,769 | B2 | 5/2006 | Zhao et al. |
| 7,050,278 | B2 | 5/2006 | Poulsen |
| 7,059,879 | B2 | 6/2006 | Krause et al. |
| 7,077,672 | B2 | 7/2006 | Krause et al. |
| 7,079,367 | B1 | 7/2006 | Liljestrand |
| 7,083,450 | B1 | 8/2006 | Hughes |
| 7,104,822 | B2 | 9/2006 | Jazowski et al. |
| 7,104,823 | B2 | 9/2006 | Jazowski et al. |
| 7,108,568 | B2 | 9/2006 | Jazowski et al. |
| 7,134,889 | B2 | 11/2006 | Hughes et al. |
| 7,150,098 | B2 | 12/2006 | Borgstrom et al. |
| 7,168,983 | B2 | 1/2007 | Graf et al. |
| 7,170,004 | B2 | 1/2007 | Gramespacher et al. |
| 7,182,647 | B2 | 2/2007 | Muench et al. |
| 7,212,389 | B2 | 5/2007 | Hughes |
| 7,216,426 | B2 | 5/2007 | Borgstrom et al. |
| 7,234,980 | B2 | 6/2007 | Jazowski et al. |
| 7,241,163 | B1 | 7/2007 | Cox et al. |
| 7,247,061 | B2 | 7/2007 | Hoxha et al. |
| 7,247,266 | B2 | 7/2007 | Bolcar |
| 7,258,585 | B2 | 8/2007 | Hughes et al. |
| 7,278,889 | B2 | 10/2007 | Muench et al. |
| 7,341,468 | B2 | 3/2008 | Hughes et al. |
| 7,351,098 | B2 | 4/2008 | Gladd et al. |
| 7,384,287 | B2 | 6/2008 | Hughes et al. |
| 7,397,012 | B2 | 7/2008 | Stepniak et al. |
| 7,413,455 | B2 | 8/2008 | Hughes et al. |
| 7,450,363 | B2 | 11/2008 | Hughes |
| 7,488,916 | B2 | 2/2009 | Muench et al. |
| 7,491,075 | B2 | 2/2009 | Hughes et al. |
| 7,494,355 | B2 | 2/2009 | Hughes et al. |
| 7,568,927 | B2 | 8/2009 | Hughes et al. |
| 7,568,950 | B2 | 8/2009 | Belopolsky et al. |
| 7,572,133 | B2 | 8/2009 | Hughes et al. |
| 7,578,682 | B1 | 8/2009 | Hughes et al. |
| 7,632,120 | B2 | 12/2009 | Hughes et al. |
| 7,633,741 | B2 | 12/2009 | Hughes et al. |
| 7,661,979 | B2 | 2/2010 | Hughes et al. |
| 7,666,012 | B2 | 2/2010 | Hughes et al. |
| 7,670,162 | B2 | 3/2010 | Hughes |
| 7,695,291 | B2 | 4/2010 | Hughes et al. |
| 2002/0055290 | A1 | 5/2002 | Jazowski et al. |
| 2007/0291442 | A1 | 12/2007 | Steinbrecher et al. |
| 2008/0192409 | A1 | 8/2008 | Roscizewski et al. |
| 2008/0207022 | A1 | 8/2008 | Hughes et al. |
| 2008/0293301 | A1 | 11/2008 | Hamner et al. |
| 2009/0211089 | A1 | 8/2009 | Hughes et al. |
| 2009/0215313 | A1 | 8/2009 | Hughes |
| 2009/0215321 | A1 | 8/2009 | Hughes |
| 2009/0233472 | A1 | 9/2009 | Hughes |
| 2009/0255106 | A1 | 10/2009 | Hughes et al. |
| 2009/0258547 | A1 | 10/2009 | Hughes et al. |

FOREIGN PATENT DOCUMENTS

| | | | |
|---|---|---|---|
| DE | 3521365 | C1 | 2/1987 |
| DE | 19906972 | A1 | 8/2000 |
| EP | 0624940 | B1 | 3/1997 |
| EP | 0782162 | A2 | 7/1997 |
| EP | 0957496 | A2 | 11/1999 |
| FR | 2508729 | | 12/1982 |
| GB | 105227 | | 2/1918 |
| GB | 2254493 | A | 10/1992 |
| JP | S62-198677 | | 12/1987 |
| JP | S63-93081 | | 6/1988 |
| JP | HI-175181 | | 7/1989 |
| JP | H3-88279 | | 9/1991 |
| JP | H4-54164 | | 5/1992 |
| WO | WO 00/41199 | A1 | 7/2000 |

OTHER PUBLICATIONS

B-NPL: Cooper Power Systems; Deadbreak Apparatus Connectors, 600 A U-OP™ Visible Break Connector System Operation Instructions, Service Information S600-14-1, Jul. 1999; 6 pages.

C-NPL: Elastimold, Link-OP™ , 600A Operable Connector System, "The missing link betwween dead-front switchgear and your operating requirements", 1 page.

D-NPL: Elastimold, Installation Instructions 650LK-B Link Operable Connector System (Bolted), May 1989; 6 pages.

E-NPL: G&W Electric Co., Trident, "Breakthrough in Switching Technology", Solid Dielectric Switchgear, Oct. 2001, 8 pages.

F-NPL: Cooper Power Systems; Padmounted Switchgear, Type RVAC, Vacuum-Break Switch, Oil-Insulated or SF6-Insulated, Electrical Apparatus 285-50, Jul. 1998, 8 pages.

G-NPL: Cooper Power Systems; Padmounted Switchgear, Type MOST Oil Switch, Electrical Apparatus 285-20, Jul. 1998, 8 pages.

H-NPL: Cooper Power Systems; Molded Rubber Products, 600 A 35 kV Class Bol-T™ Deadbreak Connector, Electrical Apparatus 600-50, Jan. 1990, 4 pages.

I-NPL: Cooper Power Systems; Padmounted Switchgear, Kyle® Type VFI Vacuum Fault Interrupter, Electrical Apparatus 285-10, Jan. 1998, 11 pages.
J-NPL: Cooper Power Systems; Loadbreak Apparatus Connectors, 200 A 25 kV and 28 kV Class, Expanded Range Loadbreak Elbow Connector, Canadian Standards Edition, Electrical Apparatus 500-28C, Feb. 2002, 6 pages.
K-NPL: Cooper Power Systems; "The Cooper Posi-Break™ Solution to Separable Connector Switching Problems at Wisconsin Electric Company", by Kevin Fox, Senior Product Specialist, Bulletin No. 98065, Oct. 1998, 2 pages.
L-NPL: Cooper Power Systems; The Cooper POSI-BREAK™ Elbow and Cap, Engineered Solution Increases Strike Distance and Improves Reliability, Bulletin 98014, Copyright 1998, 6 pages.
M-NPL: Cooper Power Systems; Loadbreak Apparatus Connectors, 200 A 25 kV Class Cooper POSI-BREAK™ Expanded Range Loadbreak Elbow Connector, Electrical Apparatus 500-29, Jan. 2004, 4 pages.
N-NPL: Cooper Power Systems; Product Brief, Latched Elbow Indicator*, Bulletin 94014, Nov. 1995, 1 page.
O-NPL: Elastimold® ,STICK-OPerable 600-Amp Connector Systems, For Safe Operation of Deadfront Apparatus, Amerace Corporation, 1984, 12 pages.
P-NPL: Cooper Power Systems; Molded Rubber Products, 600 A 15 kV Class T-OP™ II Deadbreak Connector, Electrical Apparatus, Jul. 2005, 5 pages.
Q-NPL: Cooper Power Systems; Molded Rubber Products, 600 A 15 and 25 kV Deadbreak Accessories, Tools, Replacement Parts, Electrical Apparatus 600-46, Jun. 1997, 4 pages.
R-NPL: Cooper Power Systems; Molded Rubber Products, 600 A 25 kV Class BT-TAP™ Deadbreak Connector, Electrical Apparatus 600-35, Mar. 2003, 6 pages.
S-NPL: Cooper Power Systems; Deadbreak Apparatus Connectors, 600 A 15/25 kV Class Bol-T™ Deadbreak Connector, Electrical Apparatus 600-10, Aug. 2002, 6 pages.
T-NPL: Cooper Power Systems; Deadbreak Apparatus Connector, 600 A 25 kV Class, Bushing Adapter for T-OP™ II Connector System (including LRTP amd Bushing Extender), Electrical Apparatus 600-38, Jun. 1997, 4 pages.
U-NPL: Cooper Power Systems; Loadbreak Apparatus Connectors, 200 A 15 kV Class, Loadbreak Bushing Insert, 500-12, Nov. 1995, 2 pages.
V-NPL: Cooper Power Systems; T-OP II™ , "How Many Sticks Does It Take To Operate Your 600 Amp Terminator System?", Bulletin 94025, Jul. 1994, 4 pages.
W-NPL: Elastimold® ; Installation and Operating Instructions, 168ALR, Access Port Loadbreak Elbow Connectors, IS-168ALR (Rev. C), Feb. 1994, 5 pages.
X-NPL: Elastimold® ; Operating Instructions, 200TC-2, IS-200TC-2 (Rev. A), Feb. 1995, 2 pages.
Y-NPL: Elastimold; Surge Arresters; Catalog 20001, ID 0198, pp. 26-27, 2 pages.
Z-NPL: Cooper Power Systems; Surge Arresters, Metal Oxide Elbow Surge Arrester, Electrical Apparatus 235-65, Jan. 1991, 4 pages.
ZA-NPL:Cooper Power Systems; Surge Arresters, Metal Oxide Varistor Elbow (M.O.V.E.™ ), Surge Arrester, Electrical Apparatus 235-65, Dec. 2003, 4 pages.
ZB-NPL: Cooper Power Systems; Surge Arresters, Metal Oxide Varistor (MOV), Parking Stand Surge Arrester, Electrical Apparatus 235-68, Apr. 2002, 4 pages.
ZC-NPL:Cooper Power Systems; INPLUG35, 35 kV 200 Amp Loadbreak, Injection Plug Operating and Installion Instructions, 5000050855, Jun. 2003, 1 page.
ZD-NPL: Cooper Power Systems; Loadbreak Apparatus Connectors, 200 A 15kV Class, Loadbreak Elbow Connector, Electrical Apparatus 500-10, Feb. 2004, 4 pages.
ZE-NPL: Cooper Power Systems; Loadbreak Apparatus Connectors, 200 A 15 kV and 25 kV Class Elbow Installation Instructions, Service Information S500-10-1, Feb. 2001, 4 pages.
ZF-NPL: Cooper Power Systems; Loadbreak Apparatus Connectors, 200 A 15 kV Class, Loadbreak Rotatable Feedthru Insert, Electrical Apparatus 500-13, Apr. 2001, 2 pages.
ZG-NPL: Cooper Power Systems; Loadbreak Apparatus Connectors, 200 A 25 kV Class - Expanded Range Loadbreak Elbow Connector, Electrical Apparatus 500-28, Jan. 2004, 4 pages.
ZH-NPL: Cooper Power Systems; Loadbreak Apparatus Connectors, 200 A 25 kV Class Rotatable Feedthru Insert, Elerical Apparatus 500-30, Jun. 1999, 2 pages.
ZI-NPL: Cooper Power Systems; Loadbreak Apparatus Connectors, 200 A 35 kV Class Three-Phase Loadbreak Injection Elbow Installation Instructions, Service Information S500-55-2, Apr. 1999, 6 pages.
ZJ-NPL: Cooper Power Systems; Deadbreak Apparatus Connectors, 600 A 15/25 kV Class Bol-T™ Deadbreak Connector, Electrical Apparatus 600-30, Feb. 2003, 6 pages.
ZK-NPL: Cooper Power Systems; Deadbreak Apparatus Connectors, 600 A 25 kV Class, PUSH-OP® Deadbreak Connector, Electrical Apparatus 600-33, Nov. 2004, 4 pages.
ZL-NPL: Cooper Power Systems; Molded Rubber Products, 600 A 25kV Class T-OP™ II Deadbreak Connector, Electrical Apparatus 600-32, Jul. 2005, 4 pages.
ZM-NPL: Cooper Power Systems; OEM Equipment, Four-Position Sectionalizing Loadbreak Switches, Electrical Apparatus 800-64, Dec. 2003, 8 pages.
ZN-NPL: Cooper Power Systems; Loadbreak Apparatus Connectors, 200 A 25 kV Class Loadbreak Bushing Insert, Service Information 500-26, May 2003, 2 pages.

* cited by examiner

SHIELD HOUSING FOR A SEPARABLE CONNECTOR

RELATED APPLICATION

This application is a continuation-in-part application of U.S. patent application Ser. No. 11/676,861, entitled "Thermoplastic Interface and Shield Assembly for Separable Insulated Connector System," filed on Feb. 20, 2007 now U.S. Pat. No. 7,494,355. In addition, this application is related to U.S. patent application Ser. No. 12/341,184, entitled "Method for Manufacturing a Shield Housing for a Separable Connector," filed on Dec. 22, 2008. The complete disclosure of each of the foregoing priority and related applications is hereby fully incorporated herein by reference.

TECHNICAL FIELD

The invention relates generally to separable connector systems for electric power systems, and more particularly to cost-effective separable connector shield housings with reduced potential for electrical discharge and failure.

BACKGROUND

In a typical power distribution network, substations deliver electrical power to consumers via interconnected cables and electrical apparatuses. The cables terminate on bushings passing through walls of metal encased equipment, such as capacitors, transformers, and switchgear. Increasingly, this equipment is "dead front," meaning that the equipment is configured such that an operator cannot make contact with any live electrical parts. Dead front systems have proven to be safer than "live front" systems, with comparable reliability and low failure rates.

Various safety codes and operating procedures for underground power systems require a visible disconnect between each cable and electrical apparatus to safely perform routine maintenance work, such as line energization checks, grounding, fault location, and hi-potting. A conventional approach to meeting this requirement for a dead front electrical apparatus is to provide a "separable connector system" including a first connector assembly connected to the apparatus and a second connector assembly connected to an electric cable. The second connector assembly is selectively positionable with respect to the first connector assembly. An operator can engage and disengage the connector assemblies to achieve electrical connection or disconnection between the apparatus and the cable.

Generally one of the connector assemblies includes a female connector, and the other of the connector assemblies includes a corresponding male connector. In some cases, each of the connector assemblies can include two connectors. For example, one of the connector assemblies can include ganged, substantially parallel female connectors, and the other of the connector assemblies can include substantially parallel male connectors that correspond to and are aligned with the female connectors. During a typical electrical connection operation, an operator slides the female connector(s) over the corresponding male connector(s).

Each female connector includes a recess from which a male contact element or "probe" extends. Each male connector includes a contact assembly configured to at least partially receive the probe when the female and male connectors are connected. A conductive shield housing is disposed substantially around the contact assembly, within an elongated insulated body composed of elastomeric insulating material. The shield housing acts as an equal potential shield around the contact assembly. A non-conductive nose piece is secured to an end of the shield housing and provides insulative protection for the shield housing from the probe. The nosepiece is attached to the shield housing with threaded or snap-fit engagement.

Air pockets tend to emerge in and around the threads or snap-fit connections. These air pockets provide paths for electrical energy and therefore may result in undesirable and dangerous electrical discharge and device failure. In addition, sharp edges along the threads or snap-fit connections are points of high electrical stress that can alter electric fields during loadbreak switching operation, potentially causing electrical failure and safety hazards.

One conventional approach to address these problems is to replace the shield housing and nose piece with an all-plastic sleeve coated with a conductive adhesive. The sleeve includes an integral nose piece. Therefore, there are no threaded or snap-fit connections in which air pockets may be disposed. However, air pockets tend to exist between the sleeve and the conductive adhesive. In addition, there is high manufacturing cost associated with applying the conductive adhesive to the sleeve.

Therefore, a need exists in the art for a cost-effective and safe connector system. In particular, a need exists in the art for a cost-effective separable connector shield housing with reduced potential for electrical discharge and failure.

SUMMARY

The invention is directed to separable connector systems for electric power systems. In particular, the invention is directed to a cost-effective separable connector with a shield housing having reduced potential for electrical discharge and failure. For example, the separable connector can include a male connector configured to selectively engage and disengage a mating female connector.

The shield housing includes a layer of semi-conductive material disposed at least partially around a layer of insulating or non-conductive material. As used throughout this application, a "semi-conductive" material is a rubber, plastic, thermoplastic, or other type of material that carries current, including any type of conductive material. The non-conductive material includes any non-conductive or insulating material, such as insulating plastic, thermoplastic, or rubber. The layers are molded together as a single component. For example, the semi-conductive material can be overmolded around at least a portion of the non-conductive material, or at least a portion of the non-conductive material can be insert molded within the semi-conductive material. The term "overmolding" is used herein to refer to a molding process using two separate molds in which one material is molded over another. The term "insert molding" is used herein to refer to a process whereby one material is molded in a cavity at least partially defined by another material.

The shield housing defines a channel within which at least a portion of a contact tube may be received. A conductive contact element is disposed within the contact tube. The semi-conductive material surrounds and is electrically coupled to the contact element and serves as an equal potential shield around the contact element.

The non-conductive material can extend along substantially an entire length of the connector. For example, the non-conductive material can extend from a nose end (or mating end) of the connector to a rear end of the connector. Alternatively, the non-conductive material can extend only partially along the length of the connector. For example, the non-conductive material can extend only from the nose end of the connector to a middle portion of the contact tube, between opposing ends of the contact tube.

The non-conductive material can include an integral nose piece disposed along the nose end of the connector. The nose piece can provide insulative protection for the shield housing from a probe of the mating connector. At least a substantial portion of the nose piece is not surrounded by the semi-conductive material.

These and other aspects, objects, features, and advantages of the invention will become apparent to a person having ordinary skill in the art upon consideration of the following detailed description of illustrated exemplary embodiments, which include the best mode of carrying out the invention as presently perceived.

BRIEF DESCRIPTION OF THE DRAWINGS

For a more complete understanding of the invention and the advantages thereof, reference is now made to the following description, in conjunction with the accompanying figures briefly described as follows.

DETAILED DESCRIPTION

The invention is directed to separable connector systems for electric power systems. In particular, the invention is directed to a cost-effective separable connector shield housing with reduced potential for electrical discharge and failure. The shield housing includes a layer of semi-conductive material disposed at least partially around a layer of insulating or non-conductive material. The layers are molded together. For example, the semi-conductive material can be overmolded to the non-conductive material, or the non-conductive material can be insert molded within the semi-conductive material, as described below. The molding of these layers allows for a more efficient and cost-effective manufacturing process for the shield housing, as compared to traditional shield housings that require multiple assembly steps. In addition, the molding results in a single-component shield housing with reduced potential for air gaps and electrical discharge, as compared to traditional shield housings that include spaces between sharp-edged components that are snapped, threaded, or adhesively secured together.

Turning now to the drawings in which like numerals indicate like elements throughout the figures, exemplary embodiments of the invention are described in detail.

Figure 1:
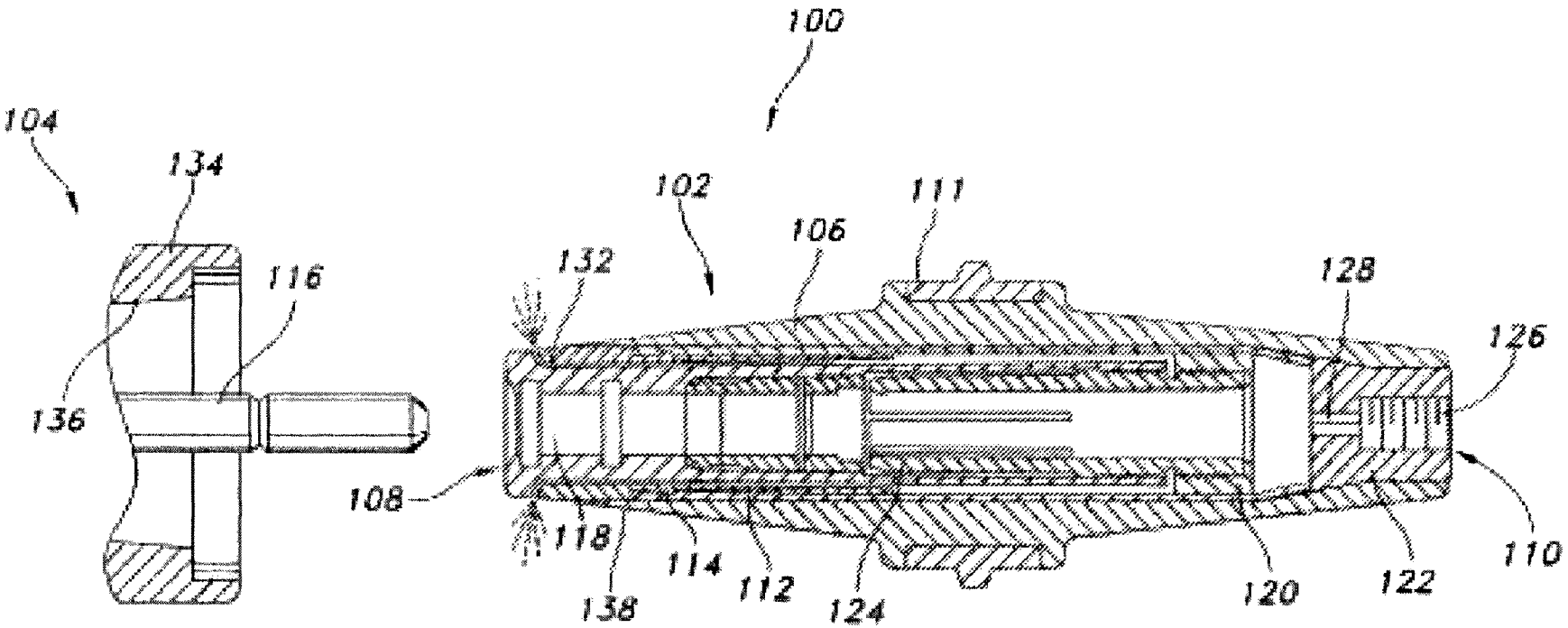
PRIOR ART FIG. 1
FIG. 1 is a cross sectional view of a known separable insulated connector system including a bushing and a connector.

FIG. 1 is a cross sectional view of a known separable insulated connector system 100, which includes a bushing 102 and a connector 104. The connector 104 may be configured, for example, as an elbow connector that may be mechanically and electrically connected to a power distribution cable on one end and is matable with the bushing 102 on the other end. Other configurations of the connector 104 are possible, including "T" connectors and other connector shapes known in the art.

The bushing 102 includes an insulated housing 106 having an axial bore therethrough that provides a hollow center to the housing 106. The housing 106 may be fabricated from elastomeric insulation such as an EPDM rubber material in one embodiment, although other materials may be utilized. The housing 106 has a first end 108 and a second end 110 opposing one another, wherein the first end 108 is open and provides access to the axial bore for mating the connector 104. The second end 110 is adapted for connection to a conductive stud of a piece of electrical equipment such as a power distribution transformer, capacitor or switchgear apparatus, or to bus bars and the like associated with such electrical equipment.

A middle portion or middle section of the housing 106 is cylindrically larger than the first and second ends 108 and 110. The middle section of the housing 106 may be provided with a semi-conductive material that provides a deadfront safety shield 111. A rigid internal shield housing 112 fabricated from a conductive metal may extend proximate to the inner wall of the insulated housing 106 defining the bore. The shield housing 112 preferably extends from near both ends of the insulated housing 106 to facilitate optimal electrical shielding in the bushing 102.

The bushing 102 also includes an insulative or nonconductive nosepiece 114 that provides insulative protection for the shield housing 112 from a ground plane or a contact probe 116 of the mating connector 104. The nosepiece 114 is fabricated from, for example, glass-filled nylon or another insulative material, and is attached to the shield housing 112 with, for example, threaded engagement or snap-fit engagement. A contact tube 118 is also provided in the bushing 102 and is a generally cylindrical member dimensioned to receive the contact probe 116.

As illustrated in FIG. 1, the bushing 102 is configured as a loadbreak connector and the contact tube 118 is slidably movable from a first position to a second position relative to the housing 106. In the first position, the contact tube 118 is retracted within the bore of the insulated housing 106 and the contact element is therefore spaced from the end 108 of the connector. In the second position the contact tube 118 extends substantially beyond the end 108 of the insulated housing 106 for receiving an electrode probe 116 during a fault closure condition. The contact tube 118 accordingly is provided with an arc-ablative component, which produces an arc extinguishing gas in a known manner during loadbreak switching for enhanced switching performance.

The movement of the contact tube 118 from the first to the second position is assisted by a piston contact 120 that is affixed to contact tube 118. The piston contact 120 may be fabricated from copper or a copper alloy, for example, and may be provided with a knurled base and vents as is known in the art, providing an outlet for gases and conductive particles to escape which may be generated during loadbreak switching. The piston contact 120 also provides a reliable, multi-point current interchange to a contact holder 122, which typically is a copper component positioned adjacent to the shield housing 112 and the piston contact 120 for transferring current from piston contact 120 to a conductive stud of electrical equipment or bus system associated therewith. The contact holder 122 and the shield housing 112 may be integrally formed as a single unit as shown in FIG. 1. The contact tube 118 will typically be in its retracted position during continuous operation of the bushing 102. During a fault closure, the piston contact 120 slidably moves the contact tube 118 to an extended position where it can mate with the contact probe 116, thus reducing the likelihood of a flashover.

A plurality of finger contacts 124 are threaded into the base of the piston contact 120 and provide a current path between the contact probe 116 and the contact holder 122. As the connector 104 is mated with the bushing 102, the contact probe 116 passes through the contact tube 118 and mechanically and electrically engages the finger contacts 124 for continuous current flow. The finger contacts 124 provide multi-point current transfer to the contact probe 116, and from the finger contacts 124 to a conductive stud of the electrical equipment associated with the bushing 102.

The bushing 102 includes a threaded base 126 for connection to the conductive stud. The threaded base 126 is positioned near the extremity of the second end 110 of the insulated housing 106 adjacent to a hex broach 128. The hex broach 128 is preferably a six-sided aperture, which assists in the installation of a bushing 102 onto a conductive stud with a torque tool. The hex broach 128 is advantageous because it allows the bushing 102 to be tightened to a desired torque.

A contoured venting path 132 is also provided in the bushing 102 to divert the flow of gases and particles away from the contact probe 116 of the connector 104 during loadbreak switching. As shown in FIG. 1, the venting path 132 redirects the flow of gases and conductive particles away from the mating contact probe 116 and away from an axis of the bushing 102, which is coincident with the axis of motion of the contact probe 116 relative to the bushing 102.

The venting path 132 is designed such that the gases and conductive particles exit the hollow area of the contact tube 118 and travel between an outer surface of the contact tube 118 and inner surfaces of the shield housing 112 and nosepiece 114 to escape from the first end 108 of the insulated housing 106. Gases and conductive particles exit the venting path 132 and are redirected away from contact probe 116 for enhanced switching performance and reduced likelihood of a re-strike.

The connector 104 also includes an elastomeric housing defining an interface 136 on an inner surface thereof that accepts the first end 108 of the bushing 102. As the connectors 102 and 104 are mated, the elastomeric interface 136 of the connector 104 engages an outer connector engagement surface or interface 138 of the insulating housing 106 of the bushing 104. The interfaces 136, 138 engage one another with a slight interference fit to adequately seal the electrical connection of the bushing 102 and the connector 104.

Figure 2:
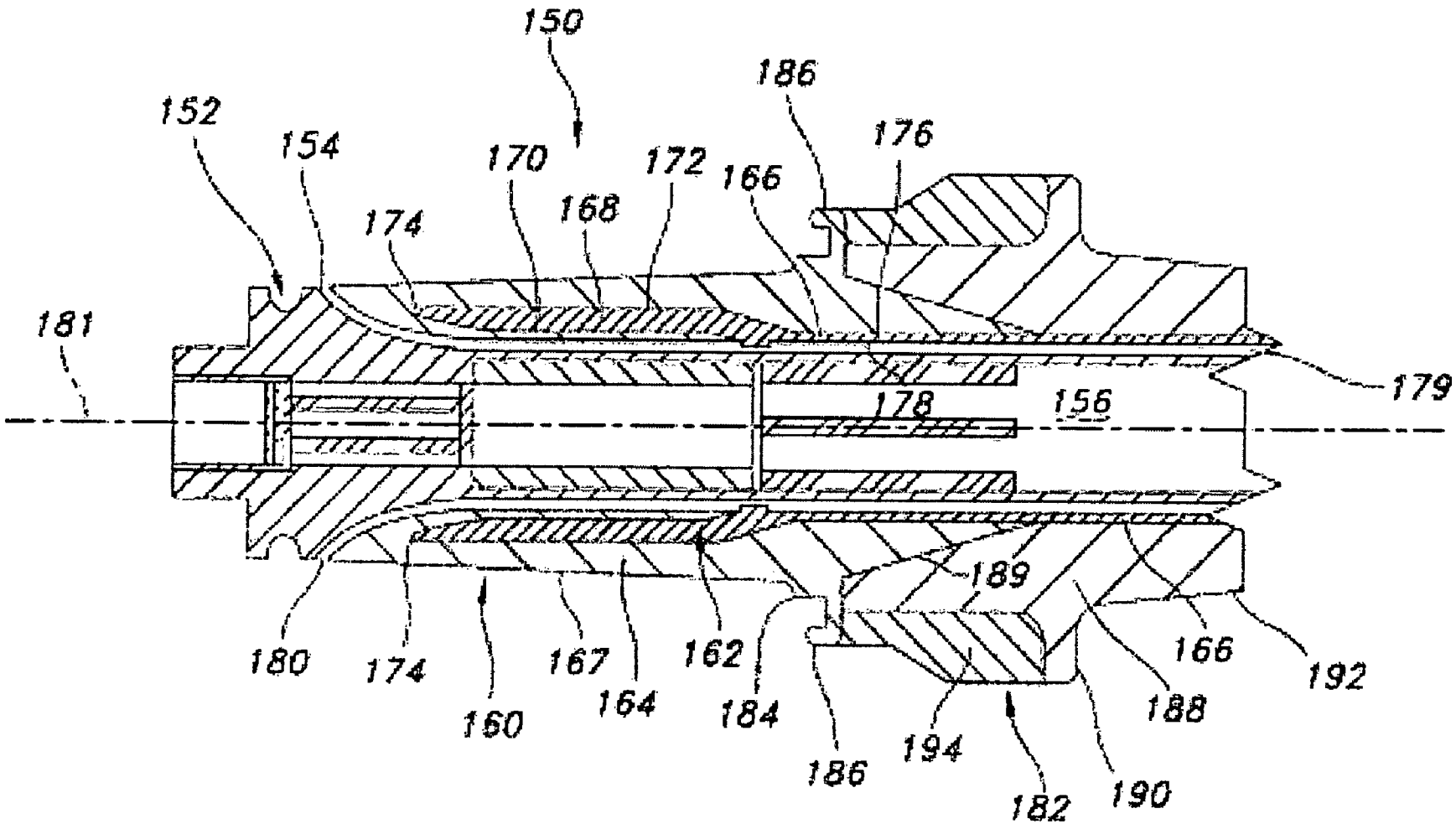
FIG. 2 is a cross sectional view of a first embodiment of a bushing formed in accordance with certain exemplary embodiments.

FIG. 2 is a cross sectional view of a first embodiment of a connector bushing 150 formed in accordance with an exemplary embodiment of the invention. The bushing 150 may be used in lieu of the bushing connector 102 shown in FIG. 1 in the connector system 100. The bushing 150 is configured as a loadbreak connector, and accordingly includes a loadbreak contact assembly 152 including a contact tube 154, a piston contact element 156 having finger contacts that is movable within the contact tube in a fault closure condition and an arc-ablative component which produces an arc extinguishing gas in a known manner during loadbreak switching for enhanced switching performance. A hex broach 158 is also provided and may be used to tighten the connector bushing 150 to a stud terminal of a piece of electrical equipment.

Unlike the embodiment of FIG. 1, the bushing connector 150 includes a shield assembly 160 surrounding the contact assembly 152 that provides numerous benefits to users and manufacturers alike. The shield assembly 160 may include a conductive shield in the form of a shield housing 162, and an insulative or nonconductive housing interface member 164 formed on a surface of the shield housing 162 as explained below. The interface member 164 may be fabricated from a material having a low coefficient of friction relative to conventional elastomeric materials such as EPDM rubber for example. Exemplary materials having such a low coefficient of friction include polytetrafluroethylene, thermoplastic elastomer, thermoplastic rubber and other equivalent materials known in the art. The housing interface member 164 is generally conical in outer dimension or profile so as to be received in, for example, the connector interface 136 of the connector 104 shown in FIG. 1.

The low coefficient of friction material used to fabricate the housing interface member 164 provides a smooth and generally low friction connector engagement surface 167 on outer portions of the interface member 164 that when engaged with the connector interface 136 (FIG. 1), which as mentioned above may be fabricated from elastomeric insulation such as EPDM rubber, enables mating of the connectors with much less insertion force than known connector systems involving rubber-to-rubber surface engagement as the connectors are mated.

As shown in FIG. 2, the shield housing 162 may be a generally cylindrical element fabricated from a conductive material and having at least two distinct portions of different internal and external diameter. That is, the shield housing 162 may be formed and fabricated with a first portion 166 having a first generally constant diameter surrounding the contact element 156 and a second portion 168 having a larger diameter than the first diameter. As such, the shield housing 162 is outwardly flared in the second portion 168 in comparison to the first portion 166. The second portion 168 defines a leading end of the shield housing 162, and is encased or encapsulated in the material of the interface member 164. That is, the low coefficient of friction material forming the interface member 164 encloses and overlies both an inner surface 170 of the housing shield leading end 168 and an outer surface 172 of the housing shield leading end 168. Additionally, a distal end 174 of the housing shield leading end 168 is substantially encased or encapsulated in the interface member 164. That is, the interface member 164 extends beyond the distal end 174 for a specified distance to provided a dielectric barrier around the distal end 174.

Such encasement or encapsulation of the housing shield leading end 168 with the insulative material of the interface member 164 fully insulates the shield housing leading end 168 internally and externally. The internal insulation, or the portion of the interface member 164 extending interior to the shield housing leading end 168 that abuts the leading end inner surface 170, eliminates any need to insulate a portion of the interior of the shield housing 162 with a separately fabricated component such as the nosepiece 114 shown in FIG. 1. Elimination of the separately provided nosepiece reduces a part count necessary to manufacture the connector bushing 150, and also reduces mechanical and electrical stress associated with attachment of a separately provided nosepiece via threads and the like. Still further, elimination of a separately provided nosepiece avoids present reliability issues and/or human error associated with incompletely or improperly connecting the nosepiece during initially assembly, as well as in subsequent installation, maintenance, and service procedures in the field. Elimination of a separately provided nosepiece also eliminates air gaps that may result between the nosepiece and the shield housing in threaded connections and the like that present possibilities of corona discharge in use.

Unlike the leading end 168 of the shield housing 162, the first portion 166 of the shield housing 162 is provided with the material of the interface member 164 only on the outer surface 176 in the exemplary embodiment of FIG. 2. That is, an inner surface 178 of the first portion of the shield housing 162 is not provided with the material of the interface member 164. Rather, a vent path 179 or clearance may be provided between the inner surface 178 of the shield housing 162 and the contact assembly 152. At the leading end of the connector 150, the vent path 179 may include a directional bend 180 to dispel gases generated in operation of the connector 150 away from an insertion axis 181 along which the connector 150 is to be mated with a mating connector, such as the connector 104 shown in FIG. 1.

Figure 3:
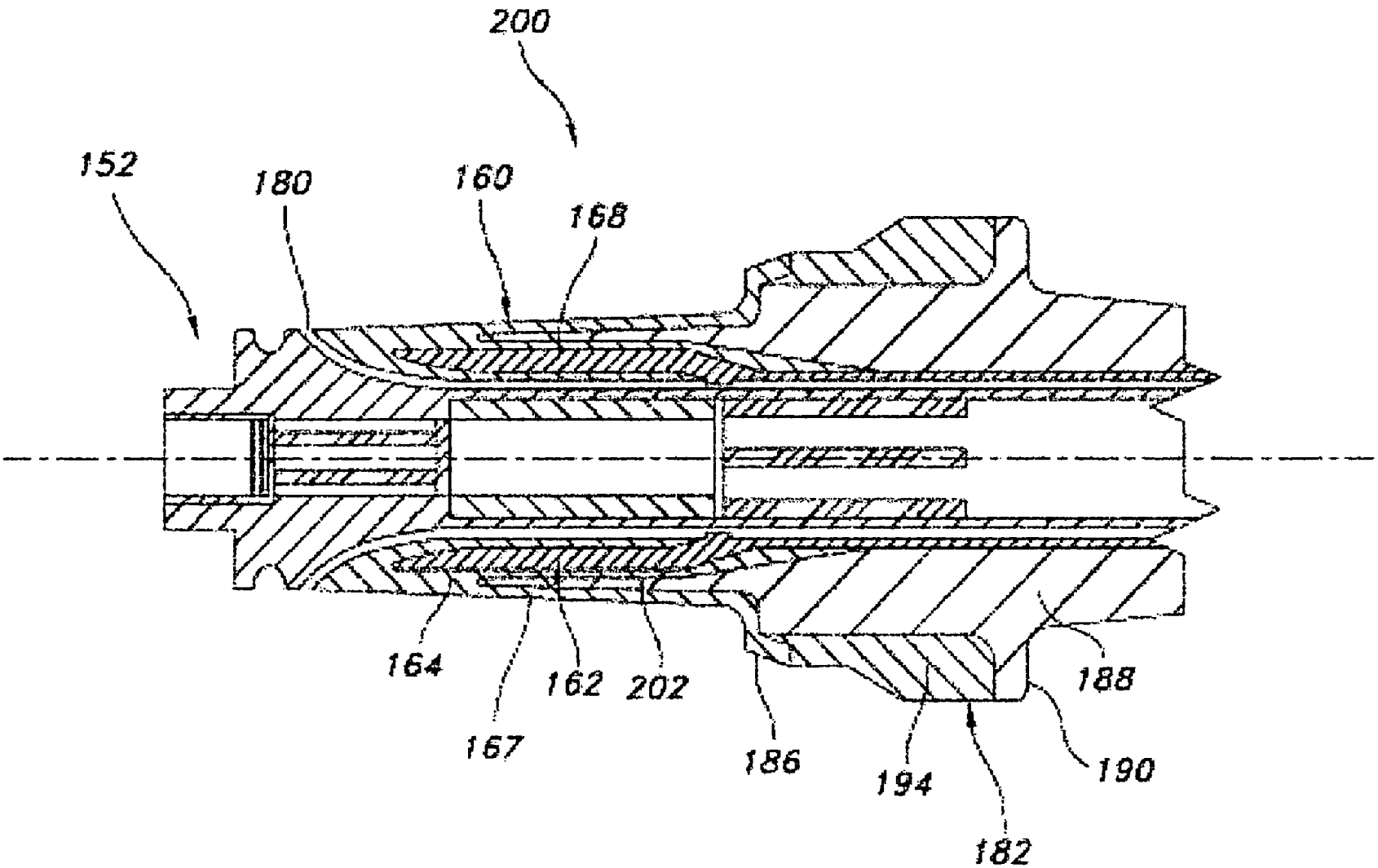
FIG. 3 is a cross sectional view of a second embodiment of a bushing formed in accordance with certain exemplary embodiments.

The interface member 164 in an illustrative embodiment extends from the distal end, sometimes referred to as the leading end that is illustrated at the left hand side in FIG. 3, to a middle section or middle portion 182 of the connector 150 that has an enlarged diameter relative to the remaining portions of the connector 150. A transition shoulder 184 may be formed into the interface member 164 at the leading end of the middle portion 182, and a latch indicator 186 may be integrally formed into the interface member 164. With integral formation of the latch indicator, separately provided latch indicator rings and other known indicating elements may be avoided, further reducing the component part count for the manufacture of the connector 150 and eliminating process steps associated with separately fabricated latch indicator rings or indication components.

In an exemplary embodiment, and as shown in FIG. 2, the latch indicator 186 is positioned proximate the shoulder 184 so that when the connector 150 is mated with the mating connector 104 (FIG. 1) the latch indicator 186 is generally visible on the exterior surface of the middle section 182 when the connectors are not fully engaged. To the contrary, the latch indicator 186 is generally not visible on the exterior surface of the middle section 182 when the connectors are fully engaged. Thus, via simple visual inspection of the middle section 182 of the connector 150, a technician or lineman may determine whether the connectors are properly engaged. The latch indicator 186 may be colored with a contrasting color than either or both of the connectors 150 and 104 to facilitate ready identification of the connectors as latched or unlatched.

The connector middle section 182, as also shown in FIG. 2, may be defined by a combination of the interface member 164 and another insulating material 188 that is different from the material used to fabricate the interface member 164. The insulation 188 may be elastomeric EPDM rubber in one example, or in another example other insulation materials may be utilized. The insulation 188 is formed into a wedge shape in the connector middle section 182, and the insulation 188 generally meets the interface member 164 along a substantially straight line 189 that extends obliquely to the connector insertion axis 181. A transition shoulder 190 may be formed in the insulation 188 opposite the transition shoulder 184 of the interface member 164, and a generally conical bushing surface 192 may be formed by the insulation 188 extending away from the connector middle section 182. A deadfront safety shield 194 may be provided on outer surface of the insulation 188 in the connector middle section 182, and the safety shield 194 may be fabricated from, for example, conductive EPDM rubber or another conductive material.

The connector 150 may be manufactured, for example, by overmolding the shield housing 162 with thermoplastic material to form the interface member 164 on the surfaces of the shield housing 162 in a known manner. Overmolding of the shield housing is an effective way to encase or encapsulate the shield housing leading end 168 with the thermoplastic insulation and form the other features of the interface member 164 described above in an integral or unitary construction that renders separately provided nosepiece components and/or latch indicator rings and the like unnecessary. The shield housing 162 may be overmolded with or without adhesives using, for example, commercially available insulation materials fabricated from, in whole or part, materials such as polytetrafluroethylene, thermoplastic elastomers, thermoplastic rubbers and like materials that provide low coefficients of friction in the end product. Overmolding of the shield housing 162 provides an intimate, surface-to-surface, chemical bond between the shield housing 162 and the interface member 164 without air gaps therebetween that may result in corona discharge and failure. Full chemical bonding of the interface member 164 to the shield housing 162 on each of the interior and exterior of the shield housing 162 eliminates air gaps internal and external to the shield housing 162 proximate the leading end of the shield housing.

Once the shield housing 162 is overmolded with the thermoplastic material to form the interface member 164, the overmolded shield housing may be placed in a rubber press or rubber mold wherein the elastomeric insulation 188 and the shield 194 may be applied to the connector 150. The overmolded shield housing and integral interface member provides a complete barrier without any air gaps around the contact assembly 152, ensuring that no rubber leaks may occur that may detrimentally affect the contact assembly, and also avoiding corona discharge in any air gap proximate the shield housing 162 that may result in electrical failure of the connector 150. Also, because no elastomeric insulation is used between the leading end of the connector and the connector middle section 182, potential air entrapment and voids in the connector interface is entirely avoided, and so are mold parting lines, mold flashings, and other concerns noted above that may impede dielectric performance of the connector 150 as it is mated with another connector, such as the connector 104 (FIG. 1).

While overmolding is one way to achieve a full surface-to-surface bond between the shield housing 162 and the interface member 164 without air gaps, it is contemplated that a voidless bond without air gaps could alternatively be formed in another manner, including but not limited to other chemical bonding methods and processes aside from overmolding, mechanical interfaces via pressure fit assembly techniques and with collapsible sleeves and the like, and other manufacturing, formation and assembly techniques as known in the art.

An additional manufacturing benefit lies in that the thermoplastic insulation used to fabricate the interface member 164 is considerably more rigid than conventional elastomeric insulation used to construct such connectors in recent times. The rigidity of the thermoplastic, material therefore provides structural strength that permits a reduction in the necessary structural strength of the shield housing 162. That is, because of increased strength of the thermoplastic insulation, the shield housing may be fabricated with a reduced thickness of metal, for example. The shield housing 162 may also be fabricated from conductive plastics and the like because of the increased structural strength of the thermoplastic insulation. A reduction in the amount of conductive material, and the ability to use different types of conductive material for the shield housing, may provide substantial cost savings in materials used to construct the connector.

FIGS. 3-6 illustrate alternative embodiments of bushing connectors that are similar to the connector 150 in many aspects and provide similar advantages and benefits. Like reference numbers of the connector 150 are therefore used in FIGS. 3-6 to indicate like components and features described in detail above in relation to FIG. 2.

FIG. 3 illustrates a bushing connector 200 wherein the interface member 164 is formed with a hollow void or pocket 202 between the housing shield leading end 168 and the connector engagement surface 167. The pocket 202 is filled with the insulation 188, while the thermoplastic insulation of the interface member encases the shield housing leading end 168 on its interior and exterior surfaces. The insulation 188 in the pocket 202 introduces the desirable dielectric properties of the elastomeric insulation 188 into the connector interface for improved dielectric performance.

Figure 4:
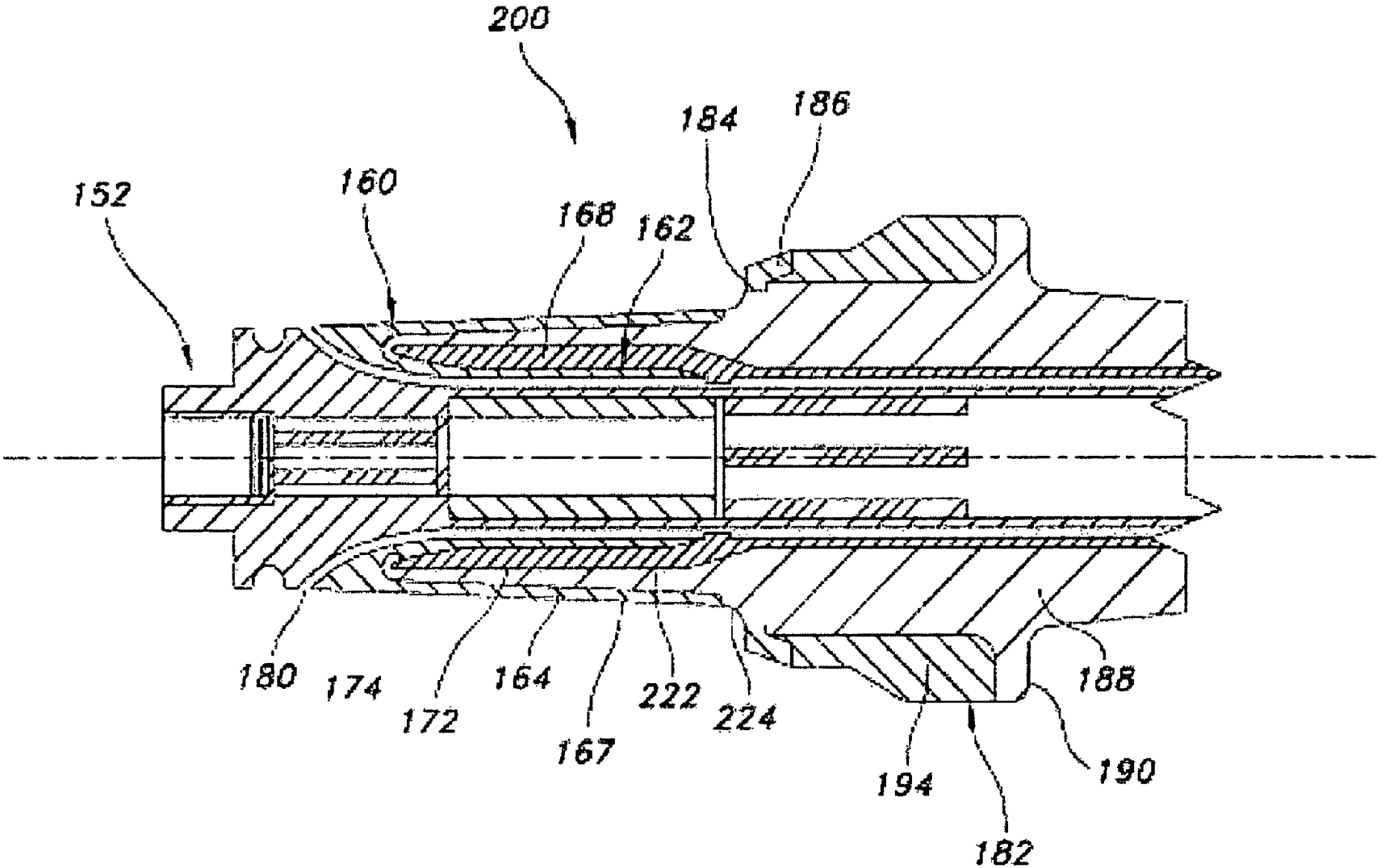
FIG. 4 is a cross sectional view of a third embodiment of a bushing formed in accordance with certain exemplary embodiments.

FIG. 4 illustrates a bushing connector 220 similar to the connector 200 but having a larger pocket 222 formed in the interface member 164. Unlike the connectors 150 and 200, the thermoplastic insulation of the interface member 164 contacts only the inner surface 170 of the shield housing leading end 168, and the elastomeric insulation 188 abuts and overlies the outer surface 172 of the shield housing leading end 168. Dielectric performance of the connector 220 may be improved by virtue of the greater amount of elastomeric insulation 188 in the connector interface. Also, as shown in FIG. 4, the transition shoulder 184 of the interface member 164 may include an opening 224 for venting purposes if desired.

Figure 5:
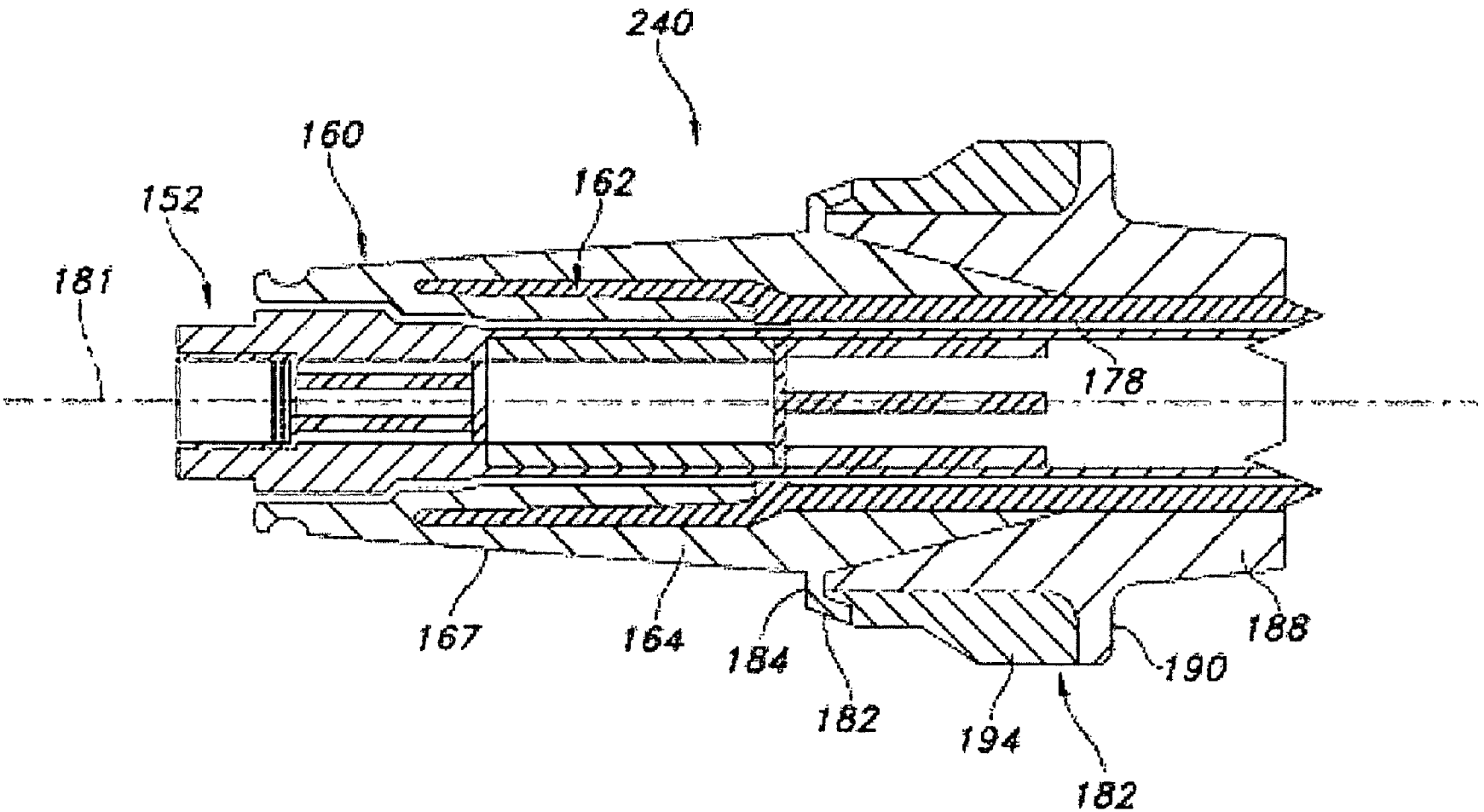
FIG. 5 is a cross sectional view of a fourth embodiment of a bushing formed in accordance with certain exemplary embodiments.

FIG. 5 illustrates a bushing connector 240 like the connector 150 (FIG. 2) but illustrating a variation of the contact assembly 152 having a different configuration at the leading end, and the connector 250 has an accordingly different shape or profile of the interface member 164 at its leading end. Also, the directional vent 180 is not provided, and gases are expelled from the vent path 178 in a direction generally parallel to the insertion axis 181 of the connector 240.

Figure 6:
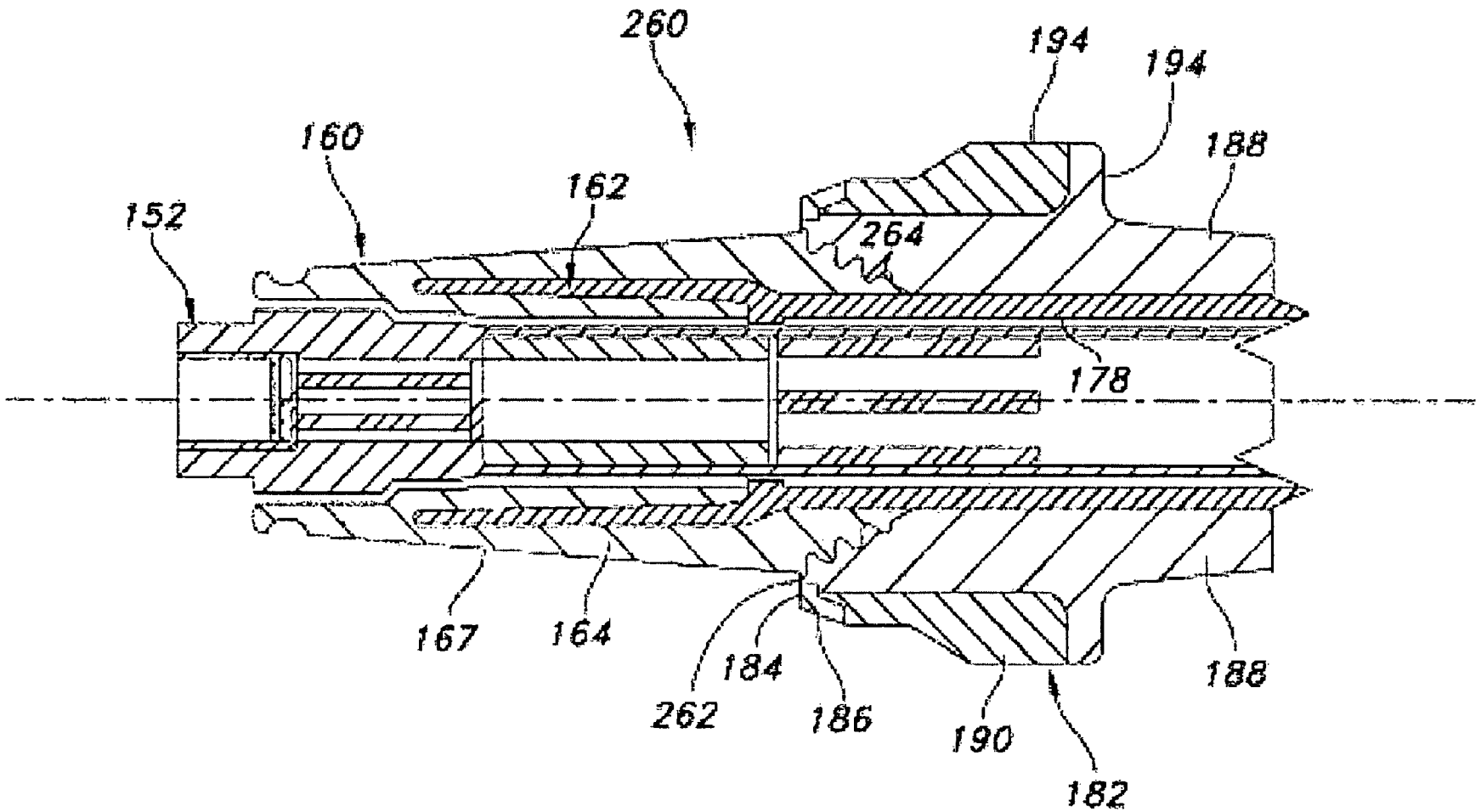
FIG. 6 is a cross sectional view of a fifth embodiment of a bushing formed in accordance with certain exemplary embodiments.

FIG. 6 illustrates a bushing connector 260 like the connector 240 (FIG. 5) wherein the transition shoulder 184 of the interface member 164 includes an opening 262 for venting and the like, and wherein the interface member 164 includes a wavy, corrugated surface 264 in the middle section 182 where the interface member 164 meets the insulation 188. The corrugated surface 264 may provide a better bond between the two types of insulation, as opposed to the embodiment of FIG. 5 wherein the insulation materials meet in a straight line boundary.

Figure 7:
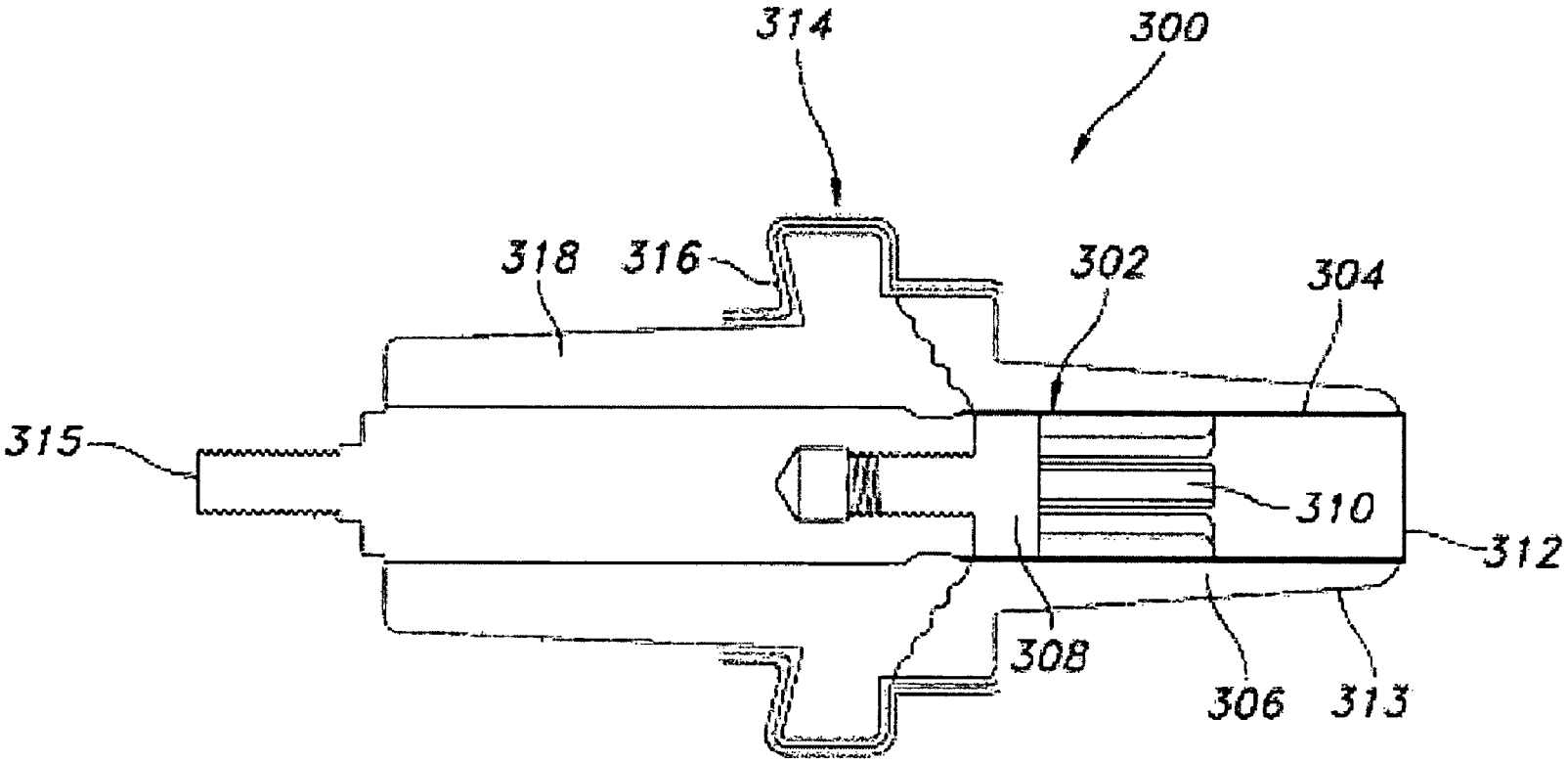
FIG. 7 is a cross sectional schematic view of a sixth embodiment of a bushing formed in accordance with certain exemplary embodiments.

FIG. 7 is a cross sectional schematic view of a sixth embodiment of a bushing connector 300 that, unlike the foregoing embodiments of FIGS. 2-6 that are loadbreak connectors, is a deadbreak connector. The bushing connector 300 may be used with a mating connector, such as the connector 102 shown in FIG. 1 in a deadbreak separable connector system. The bushing connector 300 includes a shield 302 in the form of a contact tube 304, and a contact element 308 having finger contacts 310. The contact element 308 is permanently fixed within the contact tube 304 in a spaced position from an open distal end 312 of the connector in all operating conditions. The shield 302 may be connected to a piece of electrical equipment via, for example, a terminal stud 315.

Like the foregoing embodiments, an insulative or nonconductive housing interface member 306 may be formed on a surface of the shield 302 in, for example, an overmolding operation as explained above. Also, as explained above, the interface member 306 may be fabricated from a material, such as the thermoplastic materials noted above, having a low coefficient of friction relative to conventional elastomeric materials such as EPDM rubber for example, therefore providing a low friction connector engagement surface 313 on an outer surface of the interface member 306.

The connector 300 may include a middle section 314 having an enlarged diameter, and a conductive ground plane 316 may be provided on the outer surface of the middle section 314. The middle section 314 may be defined in part by the interface member 306 and may in part be defined by elastomeric insulation 318 that may be applied to the overmolded shield 302 to complete the remainder of the connector 300. The connector 300 may be manufactured according to the basic methodology described above with similar manufacturing benefits and advantages to the embodiments described above.

The connector 300 in further and/or alternative embodiments may be provided with interface members having hollow voids or pockets as described above to introduce desirable dielectric properties of elastomeric insulation into the connector interface. Other features, some of which are described above, may also be incorporated into the connector 300 as desired.

Figure 8:
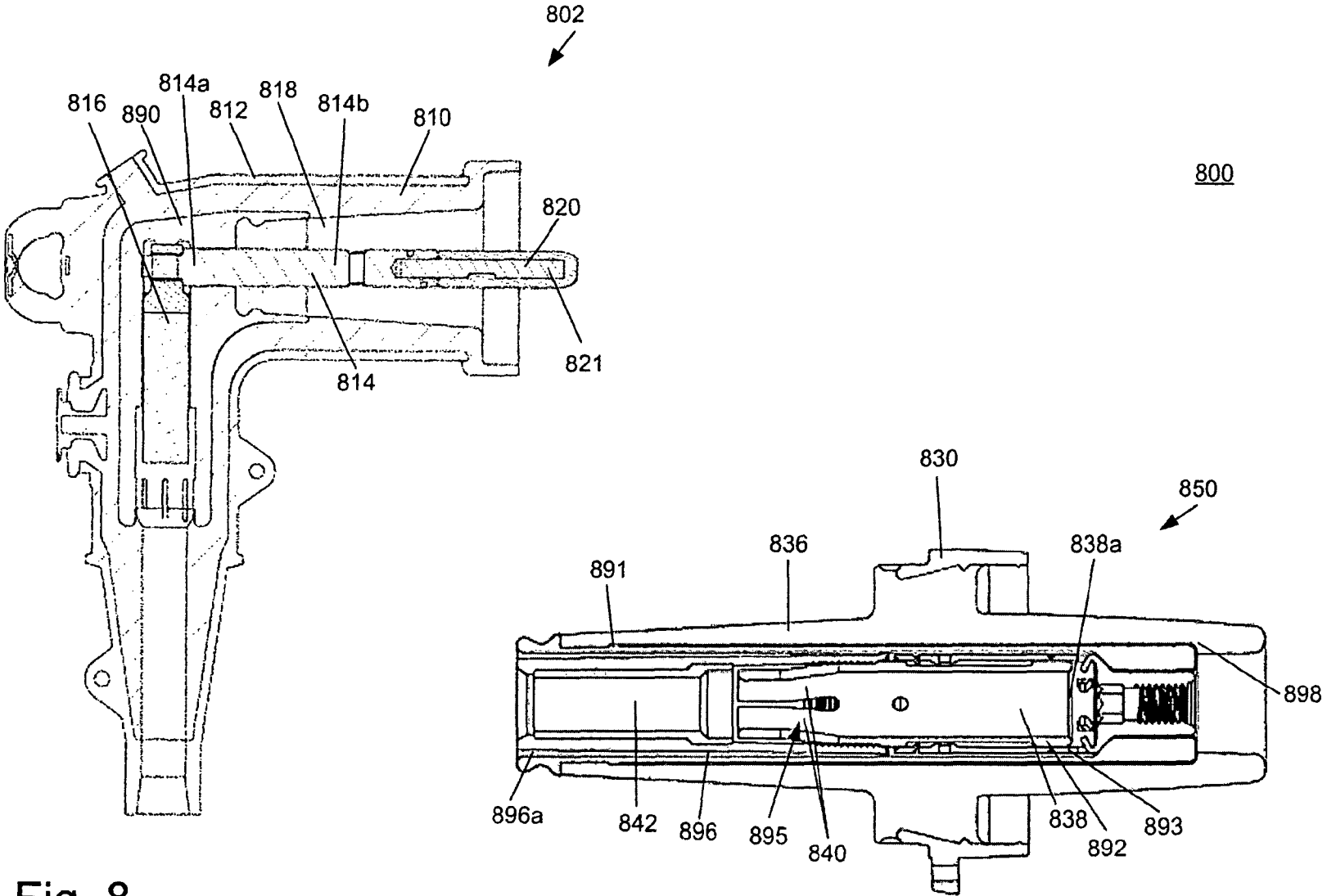
FIG. 8 is a longitudinal cross-sectional view of separable connector system, in accordance with certain exemplary embodiments.
Figure 9:
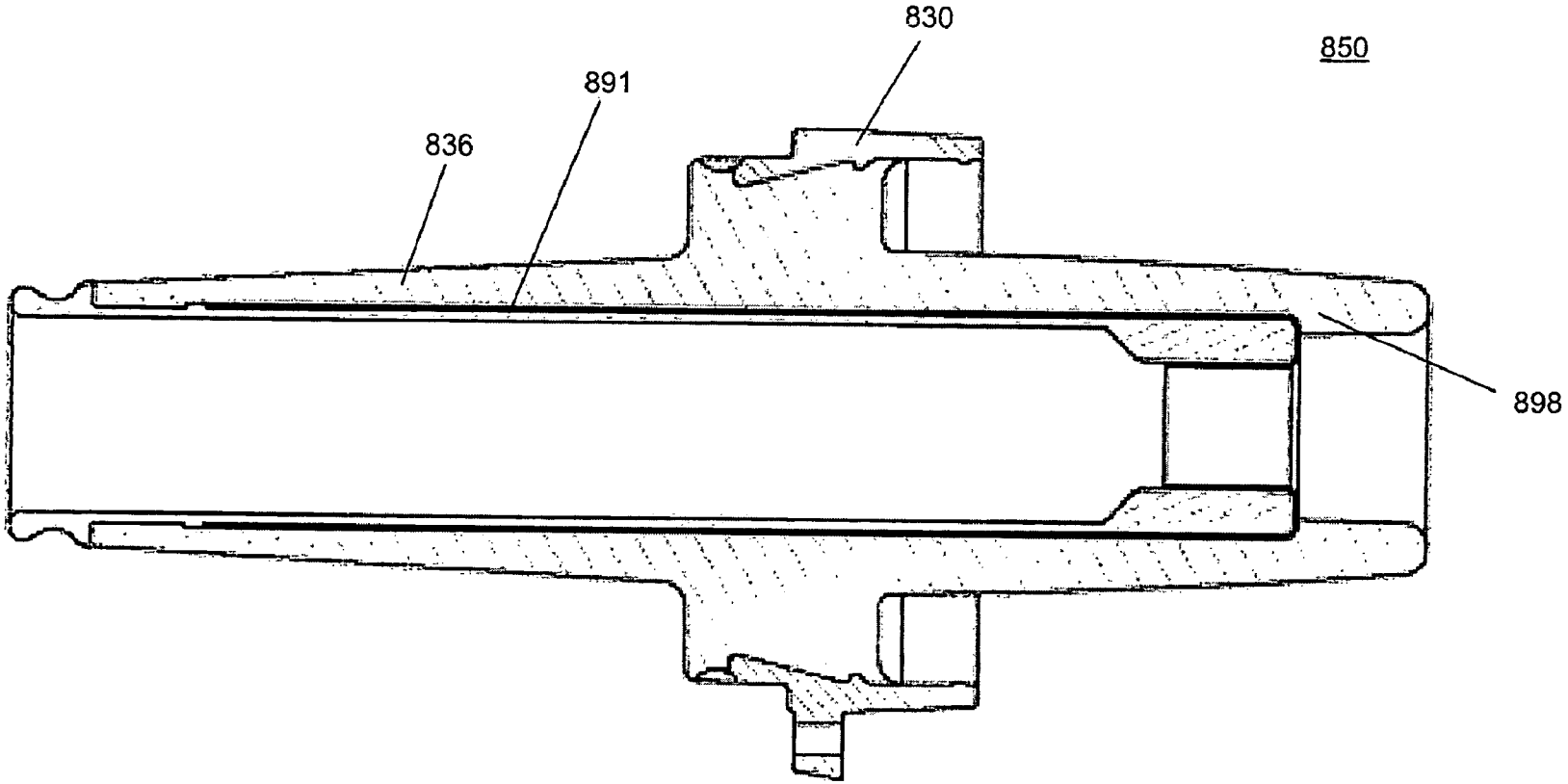
FIG. 9 is a longitudinal cross-sectional view of a male connector of the exemplary separable connector system of FIG. 8, with certain elements removed for clarity.

FIG. 8 is a longitudinal cross-sectional view of a separable connector system 800, according to certain alternative exemplary embodiments. FIG. 9 is a longitudinal cross-sectional view of a male connector 850 of the separable connector system 800, with certain elements removed for clarity. With reference to FIGS. 8 and 9, the system 800 includes a female connector 802 and the male connector 850 configured to be selectively engaged and disengaged to make or break an energized connection in a power distribution network. For example, the male connector 850 can be a bushing insert or connector connected to a live front or dead front electrical apparatus (not shown), such as a capacitor, transformer, switchgear, or other electrical apparatus. The female connector 802 can be an elbow connector or other shaped device electrically connected to the power distribution network via a cable (not shown). In certain alternative exemplary embodiments, the female connector 802 can be connected to the electrical apparatus, and the male connector 850 can be connected to the cable.

The female connector 802 includes an elastomeric housing 810 comprising an insulative material, such as ethylene-propylene-dienemonomoer ("EPDM") rubber. A conductive shield layer 812 connected to electrical ground extends along an outer surface of the housing 810. A semi-conductive material 890 extends along an interior portion of an inner surface of the housing 810, substantially about a portion of a cup shaped recess 818 and conductor contact 816 of the female connector 802. For example, the semi-conductive material 890 can included molded peroxide-cured EPDM configured to control electrical stress. In certain exemplary embodiments, the semi-conductive material 890 can act as a "faraday cage" of the female connector 802.

One end 814*a* of a male contact element or "probe" 814 extends from the conductor contact 816 into the cup shaped recess 818. The probe 814 comprises a conductive material, such as copper. The probe 814 also comprises an arc follower 820 extending from an opposite end 814*b* thereof. The arc follower 820 includes a rod-shaped member of ablative material. For example, the ablative material can include acetal co-polymer resin loaded with finely divided melamine. In certain exemplary embodiments, the ablative material may be injection molded on an epoxy bonded glass fiber reinforcing pin 821 within the probe 814.

The male connector 850 includes a semi-conductive shield 830 disposed at least partially around an elongated insulated body 836. The insulated body 836 includes elastomeric insulating material, such as molded peroxide-cured EPDM. A shield housing 891 extends within the insulated body 836, substantially around a contact tube 896 that houses a contact assembly 895. The contact assembly 895 includes a female contact 838 with deflectable fingers 840. The deflectable fingers 840 are configured to at least partially receive the arc follower 820 of the female connector 802. The contact assembly 895 also includes an arc interrupter 842 disposed proximate the deflectable fingers 840.

The female and male connectors 802, 850 are operable or matable during "loadmake," "loadbreak," and "fault closure" conditions. Loadmake conditions occur when one of the contacts 814, 838 is energized and the other of the contacts 814, 838 is engaged with a normal load. An arc of moderate intensity is struck between the contacts 814, 838 as they approach one another and until joinder of the contacts 814, 838.

Loadbreak conditions occur when mated male and female contacts 814, 838 are separated when energized and supplying power to a normal load. Moderate intensity arcing occurs between the contacts 814, 838 from the point of separation thereof until they are somewhat removed from one another. Fault closure conditions occur when the male and female contacts 814, 838 are mated with one of the contacts being energized and the other of the contacts being engaged with a load having a fault, such as a short circuit condition. In fault closure conditions, substantial arcing occurs between the contacts 814, 838 as they approach one another and until they are joined in mechanical and electrical engagement.

In accordance with known connectors, the arc interrupter 842 of the male connector 850 may generate arc-quenching gas for accelerating the engagement of the contacts 814, 838. For example, the arc-quenching gas may cause a piston 892 of the male connector 850 to accelerate the female contact 838 in the direction of the male contact 814 as the connectors 802, 850 are engaged. Accelerating the engagement of the contacts 814, 838 can minimize arcing time and hazardous conditions during fault closure conditions. In certain exemplary embodiments, the piston 892 is disposed within the shield housing 891, between the female contact 838 and a piston holder 893. For example, the piston holder 893 can include a tubular, conductive material, such as copper, extending from a rear end 838*a* of the female contact 838 to a rear end 898 of the elongated body 836.

The arc interrupter 842 is sized and dimensioned to receive the arc follower 820 of the female connector 802. In certain exemplary embodiments, the arc interrupter 842 can generate arc-quenching gas to extinguish arcing when the contacts 814, 838 are separated. Similar to the acceleration of the contact engagement during fault closure conditions, generation of the arc-quenching gas can minimize arcing time and hazardous conditions during loadbreak conditions.

Figure 10:
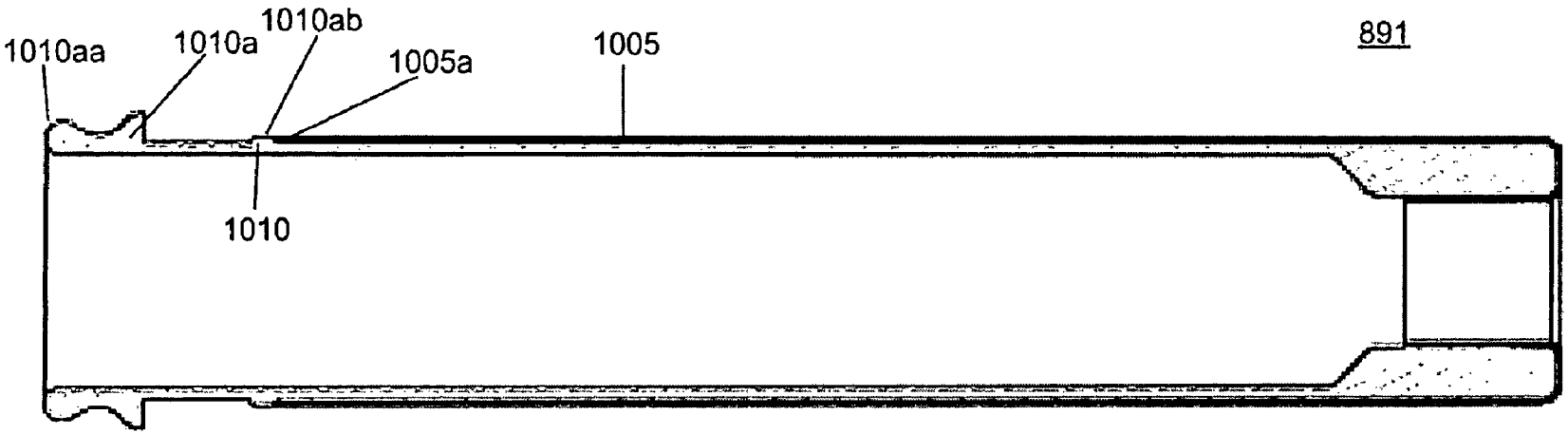
FIG. 10 is a longitudinal cross-sectional view of a shield housing of the male connector of FIG. 9, in accordance with certain exemplary embodiments.

FIG. 10 is a longitudinal cross-sectional view of the shield housing 891, according to certain exemplary embodiments. With reference to FIGS. 8-10, the shield housing 891 includes a semi-conductive portion 1005 and a non-conductive portion 1010. The semi-conductive portion 1005 includes a semi-conductive material, such as semi-conductive plastic, thermoplastic, or rubber. The non-conductive portion 1010 includes a non-conductive material, such as insulating plastic, thermoplastic, or rubber.

The non-conductive portion 1010 is disposed at least partially around the contact tube 896, the piston 892, and the piston holder 893. In certain exemplary embodiments, the non-conductive portion 1010 extends from a nose end 896*a* of the contact tube to the rear end 898 of the connector 850. The non-conductive portion 1010 includes an integral nose piece segment 1010*a* that has a first end 1010*aa* and a second end 1010*ab*. The first end 1010*aa* is disposed along at least a portion of the nose end 896*a* of the contact tube 896. The second end 1010*ab* is disposed between the nose end 896*a* and the rear end 898. For example, the second end 1010*ab* can be disposed around the arc interrupter 842. The nose piece segment 1010 provides insulative protection for the shield housing 891 from the probe 814.

The semi-conductive portion 1005 is disposed at least partially around the non-conductive portion 1010. In certain exemplary embodiments, the semi-conductive portion 1005 is disposed around substantially the entire non-conductive portion 1010 except for the nose piece segment 1010*a*. For example, the semi-conductive portion 1005 can extend between the second end 1010*ab* and the rear end 898. The semi-conductive portion 1005 is electrically coupled to the contact assembly 895. For example, the semi-conductive portion 1005 can be electrically coupled to the contact assembly 895 via a conductive path between the female contact 838, the piston 892, the piston holder 893, and a section of the semi-conductive portion 1005 disposed along the rear end 898. The semi-conductive portion 1005 acts as an equal potential shield around the contact assembly 895. For example, the semi-conductive portion 1005 can act as a faraday cage around the contact assembly 895.

In certain exemplary embodiments, the semi-conductive portion 1005 and non-conductive portion 1010 are molded together to form the shield housing 891. Specifically, a first end 1005*a* of the semi-conductive portion 1005 is molded over the second end 1010*ab* of the non-conductive portion 1010. This overmolding results in a shield housing 891 that includes only a single, molded component. Because the shield housing 891 does not include any components that are snapped, threaded, or adhesively secured together, the shield housing 891 has reduced potential for air gaps and electrical discharge, as compared to traditional shield housings that include spaces between such components. In certain alternative exemplary embodiments, the second end 1010*ab* of the non-conductive portion 1010 can be insert molded within the first end 1005*a* of the semi-conductive portion 1005. For example, the overmolding or insert molding process can include an injection or co-injection molding process.

In certain exemplary embodiments, the shield housing 891 can be manufactured by molding a first one of the portions 1005 and 1010, and then molding the other of the portions 1005 and 1010 to the first one of the portions 1005 and 1010. For example, the non-conductive portion 1010 can be molded, and then, the semi-conductive portion 1005 can be molded around or over at least a portion of the non-conductive portion 1010. Alternatively, the semi-conductive portion 1005 can be molded first, and then, the non-conductive portion 1010 can be molded under or through at least a portion of the semi-conductive portion 1005. The single step of molding these portions 1005 allows for a more efficient and cost-effective manufacturing process for the shield housing 891, as compared to traditional shield housings that require multiple assembly steps. In the exemplary embodiment depicted in FIGS. 8-10, the semi-conductive portion 1005 has a length of about 6.585 inches and an average thickness of about 0.02 inches, and the non-conductive portion 1010 has a length of about 5.575 inches and an average thickness of about 0.055 inches. In certain alternative exemplary embodiments, the semi-conductive portion 1005 and the non-conductive portion 1010 can have other lengths and thicknesses.

Figure 11:
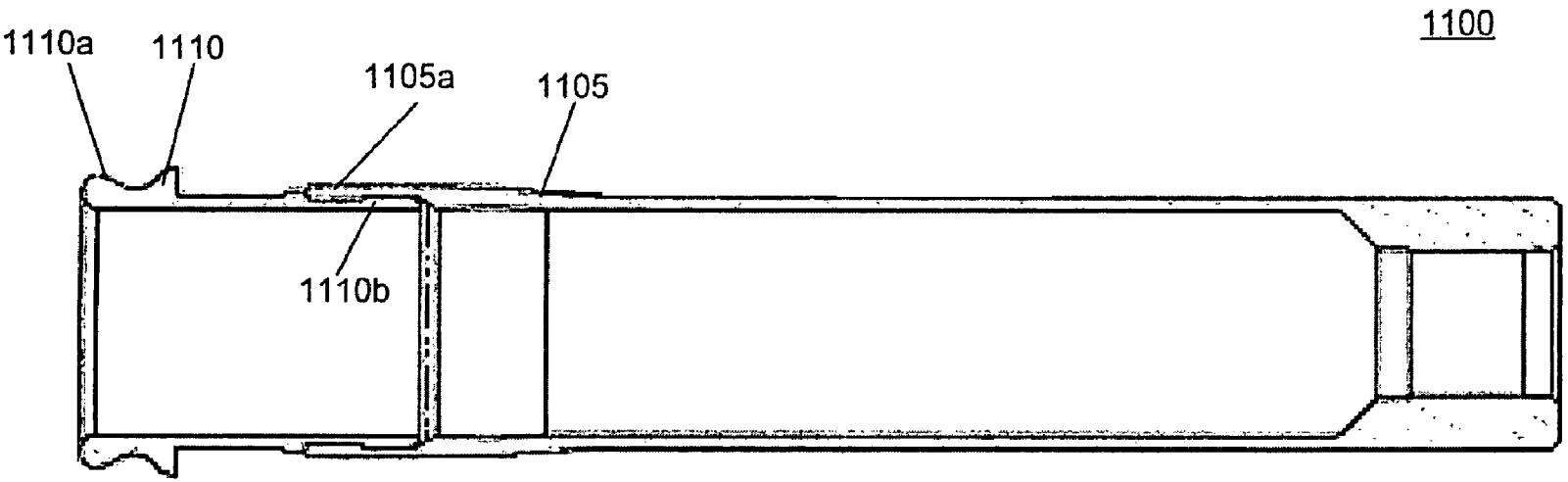
FIG. 11 is a longitudinal cross-sectional view of a shield housing, in accordance with certain alternative exemplary embodiments.

FIG. 11 is a longitudinal cross-sectional view of a shield housing 1100, according to certain alternative exemplary embodiments. With reference to FIGS. 8-11, the shield housing 1100 is substantially similar to the shield housing 891 of FIGS. 8-10, except that, unlike the non-conductive portion 1010 of the shield housing 891, the non-conductive portion 1110 of the shield housing 1100 does not extend from the nose end 896*a* of the contact tube to the rear end 898 of the connector 850. The non-conductive portion 1110 includes a first end 1110*a* disposed along at least a portion of the nose end 896*a*, and a second end 1110*b* disposed between the nose end 896 and the rear end 898. For example, the second end 1110*b* can be disposed around the arc interrupter 842. In certain exemplary embodiments, the non-conductive portion 1110 acts as a "nose piece," providing insulative protection for the shield housing 1100 from the probe 814, substantially like the nose piece segment 1010 of the shield housing 891. As with the shield housing 891, a first end 1105*a* of a semi-conductive portion 1105 is molded over the second end 1110*b* of the non-conductive portion 1110 to form the shield housing 1110. For example, the first end 1105*a* can be overmolded to the second end 1110*b*, or the second end 1110*b* can be insert molded within at least a portion of the first end 1105*a* to form the shield housing 1110. In the exemplary embodiment depicted in FIG. 11, the semi-conductive portion 1105 has a length of about 5.555 inches and an average thickness of about 0.06 inches, and the non-conductive portion 1110 has a length of about 1.5 inches and an average thickness of about 0.06 inches. In certain alternative exemplary embodiments, the semi-conductive portion 1105 and the non-conductive portion 1110 can have other lengths and thicknesses.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A separable connector, comprising:

a bushing connector comprising a contact tube comprising an arc-ablative material;

an electrical contact disposed substantially within the contact tube and configured to engage another electrical contact of a connector that mates with the bushing connector;

a shield housing surrounding at least a portion of the contact tube, the shield housing comprising a non-conductive portion; and a semi-conductive portion disposed around at least a section of the non-conductive portion, the non-conductive portion and the semi-conductive portion being molded together as a single component such that there are substantially no air gaps between the semi-conductive portion and the non-conductive portion, an insulative housing surrounding at least a portion of the shield housing, the insulative housing comprising elastomeric insulation; and an external shield comprising semi-conductive material that surrounds at least a portion of the insulative housing.

2. The separable connector of claim 1, wherein the semi-conductive portion of the shield housing comprises at least one of a conductive material and a semi-conductive material.

3. The separable connector of claim 1, wherein the semi-conductive portion of the shield housing comprises one of plastic and rubber.

4. The separable connector of claim 1, wherein the non-conductive portion of the shield housing comprises one of plastic and rubber.

5. The separable connector of claim 1, wherein the non-conductive portion of the shield housing comprises an insulating material.

6. The separable connector of claim 1, wherein the non-conductive portion of the shield housing comprises a nose piece segment formed integrally thereon, the nose piece segment defining an end of the shield housing.

7. The separable connector of claim 6, wherein the nose piece segment is disposed on a mating end of the bushing connector.

8. The separable connector of claim 6, wherein the semi-conductive portion of the shield housing is not disposed around a substantial portion of the nose piece segment.

9. A separable connector, comprising:

a bushing connector comprising a contact tube;

an electrical contact disposed substantially within the contact tube and configured to engage another electrical connector that mates with the bushing connector;

a shield housing surrounding at least a portion of the contact tube, the shield housing comprising a non-conductive portion, and a semi-conductive portion disposed around at least a section of the non-conductive portion, the non-conductive portion and the semi-conductive portion being molded together as a single component, the semi-conductive portion electrically coupled to the electrical contact and providing a substantially equal potential shield around the electrical contact;

an insulative housing surrounding at least a portion of the shield housing, the insulative housing comprising elastomeric insulation; and an external shield comprising semi-conductive material that surrounds at least a portion of the insulative housing.

10. The separable connector of claim 9, wherein the semi-conductive portion of the shield housing comprises at least one of a conductive material and a semi-conductive material.

11. The separable connector of claim 9, wherein the semi-conductive portion of the shield housing comprises one of plastic and rubber.

12. The separable connector of claim 9, wherein the non-conductive portion of the shield housing comprises one of plastic and rubber.

13. The separable connector of claim 9, wherein the non-conductive portion of the shield housing comprises an insulating material.

14. The separable connector of claim 9, wherein the non-conductive portion of the shield housing is disposed around the contact element.

15. The separable connector of claim 9, wherein the non-conductive portion of the shield housing is not disposed around the contact element.

16. The separable connector of claim 9, wherein the non-conductive portion of the shield housing comprises a nose piece segment formed integrally thereon, the nose piece segment defining a mating end of the shield housing.

17. The separable connector of claim 16, wherein the nose piece segment is disposed on a mating end of the bushing connector.

18. The separable connector of claim 16, wherein the semi-conductive portion of the shield housing is not disposed around a substantial portion of the nose piece segment.

19. A separable connector, comprising:

a bushing connector comprising a contact tube comprising an arc-ablative material;

an electrical contact disposed substantially within the contact tube and configured to engage another electrical contact of a connector that mates with the bushing connector;

a shield housing surrounding at least a portion of the contact tube, the shield housing comprising a non-conductive portion comprising an integral nose piece that defines an end of the shield housing, and a semi-conductive portion disposed around at least a section of the non-conductive portion, the non-conductive portion and the semi-conductive portion being molded together as a single component such that there are substantially no air gaps between the semi-conductive portion and the non-conductive portion, the semi-conductive portion electrically coupled to the electrical contact and providing a substantially equal potential shield around the electrical contact;

an insulative housing surrounding at least a portion of the shield housing, the insulative housing comprising elastomeric insulation; and an external shield comprising semi-conductive material that surrounds at least a portion of the insulative housing.

20. The separable connector of claim 19, wherein the semi-conductive portion of the shield housing is not disposed around a substantial portion of the integral nose piece.

* * * * *